US009310026B2

(12) United States Patent
Negley

(10) Patent No.: US 9,310,026 B2
(45) Date of Patent: Apr. 12, 2016

(54) LIGHTING ASSEMBLY AND LIGHTING METHOD

(75) Inventor: Gerald H. Negley, Durham, NC (US)

(73) Assignee: Cree, Inc., Durham, NC (US)

( * ) Notice: Subject to any disclaimer, the term of this patent is extended or adjusted under 35 U.S.C. 154(b) by 738 days.

(21) Appl. No.: 11/949,222

(22) Filed: Dec. 3, 2007

(65) Prior Publication Data

US 2008/0130282 A1 Jun. 5, 2008

Related U.S. Application Data

(60) Provisional application No. 60/868,454, filed on Dec. 4, 2006.

(51) Int. Cl.
*F21V 5/00* (2015.01)
*F21K 99/00* (2010.01)
*F21Y 101/02* (2006.01)

(52) U.S. Cl.
CPC ... *F21K 9/00* (2013.01); *F21V 5/00* (2013.01); *F21Y 2101/02* (2013.01)

(58) Field of Classification Search
CPC ..... F21V 5/007; F21V 5/00; F21V 9/00; F21V 2101/02
USPC ..... 362/249.01, 249.02, 249.06, 249.16, 362/249.14, 246
See application file for complete search history.

(56) References Cited

U.S. PATENT DOCUMENTS 2,833,176 A * 5/1958 Ossoinak ..... 352/81
3,988,609 A * 10/1976 Lewin ..... 362/296.1
4,346,275 A 8/1982 Ieakiri et al.
4,476,620 A 10/1984 Ohki et al.
4,548,470 A * 10/1985 Erland ..... 359/459
4,675,575 A 6/1987 Smith et al.
4,865,685 A 9/1989 Palmour
4,902,356 A 2/1990 Noguchi et al.
4,912,532 A 3/1990 Cook et al.
4,946,547 A 8/1990 Palmour et al.
4,981,551 A 1/1991 Palmour
5,087,949 A 2/1992 Haitz
5,103,271 A 4/1992 Izumiya et al.
5,200,022 A 4/1993 Kong et al.
5,376,241 A 12/1994 Shor et al.
5,376,580 A 12/1994 Kish et al.
RE34,861 E 2/1995 Davis et al.

(Continued)

FOREIGN PATENT DOCUMENTS

EP 0 684 648 11/1995
EP 0 936 682 8/1999

(Continued)

OTHER PUBLICATIONS

U.S. Appl. No. 11/939,059, filed Nov. 13, 2007 by inventors: Trott et al.*

(Continued)

*Primary Examiner* — Stephen F Husar
(74) *Attorney, Agent, or Firm* — Burr & Brown, PLLC

(57) ABSTRACT

There is provided a lighting assembly comprising a plurality of lighting devices, each of which comprises a patterned diffuser having optical features. Each of the lighting devices is positioned such that if they are illuminated, at least 50, and in some cases 75 or more, percent of light emitted from each of the lighting devices will contact an illumination surface within an area of a defined shape (e.g., square, rectangular, hexagonal, octagonal, etc.), the respective shapes each sharing at least one boundary with another shape. Also, methods of lighting comprising illuminating lighting devices positioned in such a way.

32 Claims, 5 Drawing Sheets

(56) References Cited

U.S. PATENT DOCUMENTS

Figure 1:
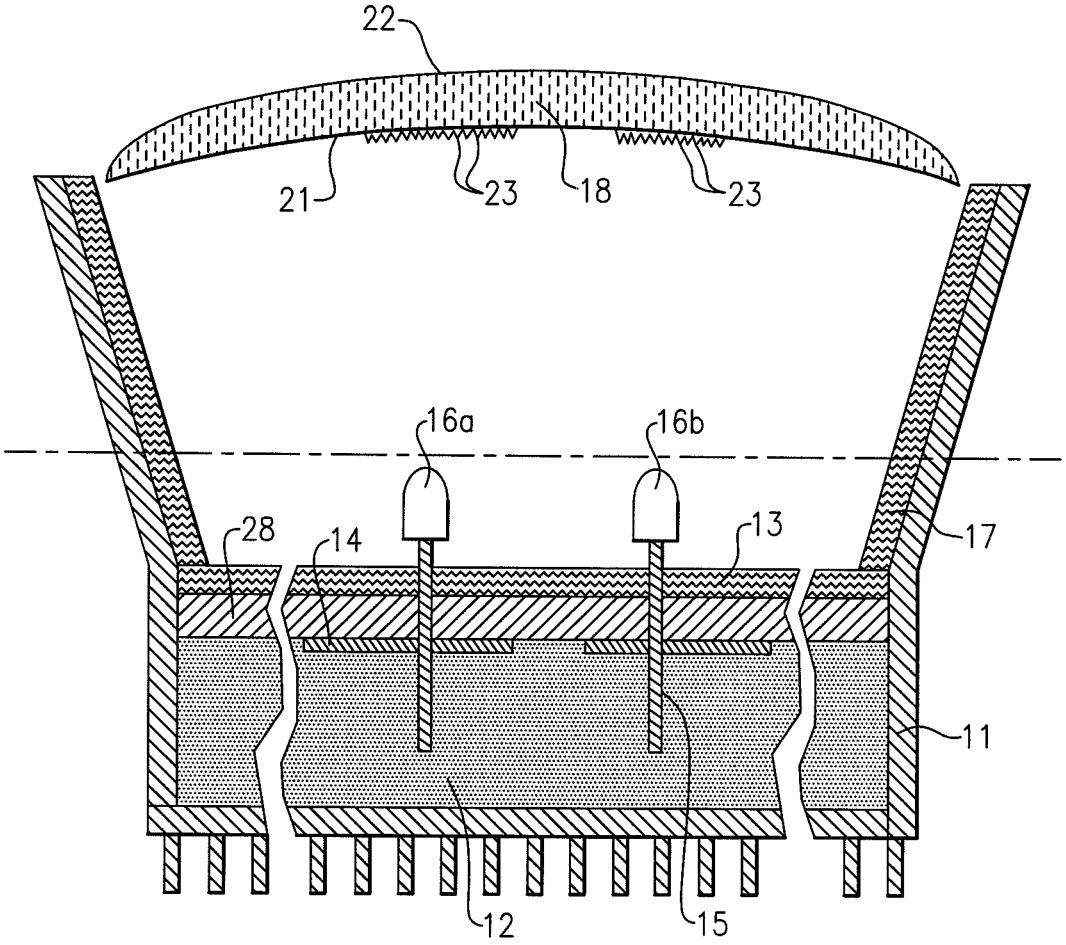

| | | | | |
|---|---|---|---|---|
| 5,442,252 | A * | 8/1995 | Golz | F21V 5/048 313/111 |
| 5,477,436 | A * | 12/1995 | Bertling et al. | 362/545 |
| 5,493,481 | A * | 2/1996 | Wiegand | 362/97.1 |
| 5,502,316 | A | 3/1996 | Kish et al. | |
| 5,644,156 | A | 7/1997 | Suzuki et al. | |
| 5,709,463 | A * | 1/1998 | Igram | 362/268 |
| 5,743,633 | A * | 4/1998 | Chau et al. | 362/331 |
| 5,833,355 | A * | 11/1998 | You et al. | 362/244 |
| 5,939,732 | A | 8/1999 | Kurtz et al. | |
| 5,959,316 | A | 9/1999 | Lowery | |
| 5,985,687 | A | 11/1999 | Bowers et al. | |
| 6,071,795 | A | 6/2000 | Cheung et al. | |
| 6,079,854 | A * | 6/2000 | Ra | 362/342 |
| 6,099,154 | A * | 8/2000 | Olney | 362/494 |
| 6,225,647 | B1 | 5/2001 | Kurtz et al. | |
| 6,258,699 | B1 | 7/2001 | Chang et al. | |
| 6,274,924 | B1 | 8/2001 | Carey et al. | |
| 6,303,276 | B1 * | 10/2001 | Savant et al. | 430/321 |
| 6,303,405 | B1 | 10/2001 | Yoshida et al. | |
| 6,330,111 | B1 | 12/2001 | Myers | |
| 6,331,915 | B1 | 12/2001 | Myers | |
| 6,365,429 | B1 | 4/2002 | Kneissl et al. | |
| 6,410,942 | B1 | 6/2002 | Thibeault et al. | |
| 6,420,199 | B1 | 7/2002 | Coman et al. | |
| 6,420,242 | B1 | 7/2002 | Cheung et al. | |
| 6,429,460 | B1 | 8/2002 | Chen et al. | |
| 6,448,102 | B1 | 9/2002 | Kneissl et al. | |
| 6,452,648 | B2 | 9/2002 | Maeda | |
| 6,465,809 | B1 | 10/2002 | Furukawa et al. | |
| 6,468,824 | B2 | 10/2002 | Chen et al. | |
| 6,520,666 | B1 * | 2/2003 | Beyerlein et al. | 362/471 |
| 6,554,451 | B1 * | 4/2003 | Keuper | 362/237 |
| 6,559,075 | B1 | 5/2003 | Kelly et al. | |
| 6,562,648 | B1 | 5/2003 | Wong et al. | |
| 6,599,002 | B2 * | 7/2003 | Hsieh et al. | 362/555 |
| 6,601,768 | B2 * | 8/2003 | McCall et al. | 235/462.42 |
| 6,607,931 | B2 | 8/2003 | Streubel | |
| 6,657,236 | B1 | 12/2003 | Thibeault et al. | |
| 6,657,393 | B2 | 12/2003 | Natsume | |
| 6,677,173 | B2 | 1/2004 | Ota | |
| 6,716,654 | B2 | 4/2004 | Hsu et al. | |
| 6,717,526 | B2 * | 4/2004 | Martineau et al. | 340/815.45 |
| 6,740,604 | B2 | 5/2004 | Kelly et al. | |
| 6,757,314 | B2 | 6/2004 | Kneissl et al. | |
| 6,786,390 | B2 | 9/2004 | Yang et al. | |
| 6,800,500 | B2 | 10/2004 | Coman et al. | |
| 6,806,112 | B1 | 10/2004 | Horng et al. | |
| 6,809,341 | B2 | 10/2004 | Hsu et al. | |
| 6,846,686 | B2 | 1/2005 | Saeki et al. | |
| 6,849,878 | B2 | 2/2005 | Bader et al. | |
| 6,884,647 | B2 | 4/2005 | Sakai et al. | |
| 6,932,497 | B1 * | 8/2005 | Huang | 362/494 |
| 6,949,401 | B2 | 9/2005 | Kaminski et al. | |
| 6,972,438 | B2 | 12/2005 | Li et al. | |
| 7,068,332 | B2 * | 6/2006 | Liu et al. | 349/64 |
| 7,084,435 | B2 | 8/2006 | Sugimoto et al. | |
| 7,116,485 | B2 * | 10/2006 | Po-Hung et al. | 359/626 |
| 7,455,416 | B2 * | 11/2008 | Chen | 362/85 |
| 7,629,570 | B2 * | 12/2009 | Mondloch et al. | 250/227.11 |
| 7,648,256 | B2 * | 1/2010 | Shiratsuchi et al. | 362/268 |
| 7,744,242 | B2 * | 6/2010 | Kramer | 362/231 |
| 7,850,280 | B2 * | 12/2010 | Oyanagi et al. | 347/51 |
| 7,855,335 | B2 * | 12/2010 | Maeda | 136/246 |
| 8,337,045 | B2 * | 12/2012 | Negley | F21V 5/00 362/246 |
| 8,439,531 | B2 * | 5/2013 | Trott | F21S 8/02 362/147 |
| 2001/0002355 | A1 * | 5/2001 | Savant et al. | 451/38 |
| 2002/0024822 | A1 * | 2/2002 | Pond et al. | 362/555 |
| 2002/0054495 | A1 | 5/2002 | Natsume | |
| 2002/0139990 | A1 | 10/2002 | Suehiro et al. | |
| 2002/0149943 | A1 * | 10/2002 | Obata | 362/339 |
| 2002/0153835 | A1 | 10/2002 | Fujiwara et al. | |
| 2002/0163302 | A1 | 11/2002 | Nitta et al. | |
| 2003/0156410 | A1 * | 8/2003 | Ter-Hovhannisian | 362/241 |
| 2003/0173602 | A1 | 9/2003 | Hsu et al. | |
| 2004/0070004 | A1 | 4/2004 | Eliashevich et al. | |
| 2004/0072382 | A1 | 4/2004 | Kelly et al. | |
| 2004/0094774 | A1 | 5/2004 | Steigerwald et al. | |
| 2004/0130891 | A1 * | 7/2004 | Twardawski | 362/157 |
| 2004/0136171 | A1 * | 7/2004 | Patton et al. | 362/31 |
| 2004/0188697 | A1 | 9/2004 | Brunner et al. | |
| 2004/0207313 | A1 | 10/2004 | Omoto et al. | |
| 2005/0077535 | A1 | 4/2005 | Li | |
| 2005/0082562 | A1 | 4/2005 | Ou et al. | |
| 2005/0117320 | A1 | 6/2005 | Leu et al. | |
| 2005/0152127 | A1 | 7/2005 | Kamiya et al. | |
| 2005/0201109 | A1 * | 9/2005 | Shimura | 362/382 |
| 2005/0207166 | A1 * | 9/2005 | Kan et al. | 362/373 |
| 2005/0227379 | A1 | 10/2005 | Donofrio | |
| 2006/0028830 | A1 * | 2/2006 | Tsai | 362/509 |
| 2006/0082700 | A1 * | 4/2006 | Gehlsen et al. | 349/64 |
| 2006/0146516 | A1 * | 7/2006 | Li et al. | 362/84 |
| 2006/0152931 | A1 * | 7/2006 | Holman | 362/297 |
| 2006/0158899 | A1 | 7/2006 | Ayabe et al. | |
| 2006/0220046 | A1 | 10/2006 | Yu et al. | |
| 2007/0070616 | A1 * | 3/2007 | Segawa | 362/97 |
| 2007/0090383 | A1 | 4/2007 | Ota et al. | |
| 2007/0139923 | A1 | 6/2007 | Negley | |
| 2007/0147041 | A1 * | 6/2007 | Shiratsuchi | F21V 5/007 362/268 |
| 2007/0170447 | A1 | 7/2007 | Negley | |
| 2007/0236911 | A1 | 10/2007 | Negley | |
| 2007/0263393 | A1 | 11/2007 | Van de Ven | |
| 2007/0274063 | A1 | 11/2007 | Negley | |
| 2007/0274080 | A1 | 11/2007 | Negley | |
| 2007/0279903 | A1 | 12/2007 | Negley | |
| 2007/0280624 | A1 | 12/2007 | Negley | |
| 2008/0036364 | A1 | 2/2008 | Li et al. | |
| 2008/0043466 | A1 * | 2/2008 | Chakmakjian et al. | 362/237 |
| 2008/0062682 | A1 * | 3/2008 | Hoelen et al. | 362/231 |
| 2008/0074032 | A1 | 3/2008 | Yano et al. | |
| 2008/0084685 | A1 | 4/2008 | Van de Ven | |
| 2008/0084700 | A1 | 4/2008 | Van de Ven | |
| 2008/0084701 | A1 | 4/2008 | Van de Ven | |
| 2008/0089053 | A1 | 4/2008 | Negley | |
| 2008/0106895 | A1 | 5/2008 | Van de Ven | |
| 2008/0106907 | A1 | 5/2008 | Trott | |
| 2008/0112168 | A1 | 5/2008 | Pickard | |
| 2008/0112170 | A1 | 5/2008 | Trott | |
| 2008/0112183 | A1 | 5/2008 | Negley | |
| 2008/0130281 | A1 | 6/2008 | Negley | |
| 2008/0308825 | A1 | 12/2008 | Chakraborty | |
| 2009/0021841 | A1 | 1/2009 | Negley et al. | |
| 2009/0152573 | A1 | 6/2009 | Loh | |
| 2009/0231835 | A1 | 9/2009 | Roberts et al. | |

FOREIGN PATENT DOCUMENTS

| | | |
|---|---|---|
| EP | 1 059 667 | 12/2000 |
| EP | 1 156 020 | 11/2001 |
| EP | 1 198 016 | 4/2002 |
| EP | 1 246 266 | 10/2002 |
| EP | 1 263 058 | 12/2002 |
| EP | 1 345 275 | 9/2003 |
| EP | 1 681 509 | 7/2006 |
| FR | 2 759 188 | 8/1998 |
| FR | 2 814 220 | 3/2002 |
| JP | 61-059886 | 3/1986 |
| JP | 07-007179 | 10/1995 |
| JP | 11-238913 | 8/1999 |
| WO | 98/56043 | 12/1998 |
| WO | 03/005458 | 1/2003 |
| WO | 03/010832 | 2/2003 |
| WO | 03/044870 | 5/2003 |
| WO | 2005/104247 | 11/2005 |
| WO | 2007/061758 | 5/2007 |

OTHER PUBLICATIONS

American Handbook of Physics Handbook, 3rd Edition, McGraw-Haill, Ed: Dwight E. Gray, 1972.

(56) References Cited

OTHER PUBLICATIONS

Kasugai et al., *Moth-Eye Light-Emitting Diodes*, Mater Res. Soc. Symp. Proc. vol. 831, 2005, Material Research Society, pp. E1.9.1-E1.9.6.
Kelner, G., et al., *Plasma Etching of BETA-SiC*, Journal of the Electrochemical Society, Manchester, New Hampshire, U.S. vol. 134, No. 1, Jan. 1987, pp. 253-254.
Khan, F.A., et al., *High Rate Etching of SiC Using Inductively Coupled Plasma Reactive Ion Etching in SF6-Based Gas Mixtures*, Applied Physics Letters, AIP, American Institute of Physics, Melville, NY, US, vol. 75, No. 15, Oct. 11, 1999, pp. 2268-2270.
Lagoubi et al., *Conditioning of N-Silicon by Photoelectrochimical Etching for Photovoltaic Application*, Proc. of the 11th E.C. Photovoltaic Solar Energy Conference, Oct. 12, 1992-Oct. 16, 1992, pp. 250-253, XP008043956, pp. 252-253, Fig. 8.
Lin et al., *Design and Fabrication of Omnidirectional Reflectors in the Visible Range*, Journal of Modern Otpics, vol. 52, No. 8, May 2005, pp. 1155-1160.
Mimura et al., *Blue Electroluminescence from Pourous Silicon Carbide*, Appl. Phys. Lett 65(26), Dec. 26, 1994, pp. 3350-3352.
Nichia, White LED, Part Nos. NSPW300BS, "Specifications for Nichia White LED, Model NSPW300BS," Nichia Corporation, Jan. 12, 2004.
Nichia, White LED, Part Nos. NSPW312BS, "Specifications for Nichia White LED, Model NSPW312BS," Nichia Corporation, Jan. 14, 2004.
Palmour, J.W., et al., *Crystallographic Etching Phenomenon during Plasma Etching of SiC (100) Thin Films in SF6*, Journal of the Electrochemical Society, Electrochemical Society, Manchester, N Hampshire, U.S., vol. 136, No. 2, Feb. 1, 1989, pp. 491-495.
Perduijn et al., *Light Output Feedback Solution for RGB LED Backlight Applications*, SID Digest (2000).
Perrin et al., *Left-Handed Electromagnetism obtained via Nanostructured Metamaterials: Comparison with that from Microstructured Photonic Cyrstals*,Journal of Opics A: Pure and Applied Optics 7 (2005), S3-S11.
Schnitzer, et al., *30% External Quantum Efficieny from Surface Textured, Thin-Film Light-Emitting Diodes*, Applied Physics Left. 63(16), Oct. 18, 1993, pp. 2174-2176.
Shor, et al., *Direct Observation of Porous SiC formed by Anodization in HF*, Appl. Phys. Lett. 62(22), May 31, 1993, pp. 2836-2838.
Streusel et al., *High Brightness AlGaInP Light-Emitting Diodes*, IEEE Journal on Selected Topis in Quantum Electronics, Vo. 8, Now. 2, Mar./Apr. 2002, pp. 321-332.
Windisch et al., *Non-Resonant Cavity Light-Emitting Diodes, in Light Emitting Diodes: Research Manufacturing, and Applications* 1V, H. Walter Yao et al., Proceding of SPIE vol. 3938 (2000), pp. 70-76.
Windisch, R., et al., "40% Efficient Thin-Film Surface-Textured Light-Emitting Diodes by Optimization of Natural Lithography," IEEE Transactions on Electron Devices, ISSN: 0018-9383, vol. 47 No. 7, Jul. 2000, pp. 1492-1498.
Windisch, R., et al., *Impact of Texture-Enhanced Transmission of High-Efficiency Surface-Textured Light-Emitting Diodes, Applied Physics Letters*, vol. 79, No. 15, Oct. 8, 2001, pp. 2315-2317.
Windisch, R., et al., *Light Extraction Mechanisms in High-Efficiency Surface-Textured Light-Emitting Diodes*, IEEE Journal on Selected Topics in Quantum Electronics, vol. 8, No. 2, Mar./Apr. 2002, pp. 248-255.
Zangooie et al., *Surface, Pore Morphology, and Optical Properties of Porous 4H-SiC*, Journal of the Electrochemical Society, 148(6) G297-G302 (2001), Jan. 9, 2001.
Zhu et al., *Optimizing the Performance of Remote Phosphor LED*, First International Conference on White LED's and Solid State Lighting, PW-48 (Nov. 26-30, 2007).
Kim, J. K. et al., "Strongly Enhanced Phosphor Efficiency in GaInN White Light-Emitting Diodes Using Remote Phosphor Configuration and Diffuse Reflector Cup," Japanese Journal of Applied Japan Socient of applied Physics, Tokyo, JP, vol. 44, No. 20-23, XP-001236966, Jan. 1, 2005.
Sakai et al., *Experimental Investigation of Dependence of Electrical Characteristics on Device Pammeters in Trench Mos BarrierShottky Diodes*, Proceedings of 1998 International Symposium on power Semiconductor Devices & ICs, Kyoto, pp. 293-296, Jun. 1998.
Zhang AP et al., *Comparison of GAN P-I-N. and Schottky Rectifier Performance*, IEEE Transactions on Electron Devices, IEEE Inc., New York, US, Vo. 48, No. 3, pp. 407-411, Mar. 2001.

* cited by examiner

LIGHTING ASSEMBLY AND LIGHTING METHOD

CROSS-REFERENCE TO RELATED APPLICATIONS

This application claims the benefit of U.S. Provisional Patent Application No. 60/868,454, filed Dec. 4, 2006, the entirety of which is incorporated herein by reference.

FIELD OF THE INVENTION(S)

The present inventive subject matter relates to a lighting assembly, in particular to a lighting assembly which comprises at least one lighting device which comprises optical features. The present inventive subject matter also relates to a lighting method which comprises passing light through a device with optical features.

BACKGROUND OF THE INVENTION(S)

A large proportion (some estimates are as high as twenty-five percent) of the electricity generated in the United States each year goes to lighting. There is an ongoing need to provide lighting which is more is more energy-efficient and/or which satisfies ever-changing lighting needs.

BRIEF SUMMARY OF THE INVENTION(S)

According to a first aspect of the present inventive subject matter, there is provided a lighting assembly comprising:

at least first, second, third, fourth and fifth lighting devices, each of the first, second, third, fourth and fifth lighting devices comprising at least one patterned diffuser, each of the patterned diffusers comprising a plurality of optical features, wherein each of the first, second, third, fourth and fifth lighting devices is positioned relative to each other such that if each of the first, second, third, fourth and fifth lighting devices is illuminated and an illumination surface is positioned such that at least a portion of light emitted from each of the first, second, third, fourth and fifth lighting devices travels in a direction substantially perpendicular to the illumination surface:

at least 50, in some cases at least 75, in some cases at least 85, and in some cases at least 90 or 95 percent of light emitted from the first lighting device will contact the illumination surface within a first rectangular area defined by a first line segment, a second line segment, a third line segment and a fourth line segment;

at least 50, in some cases at least 75, in some cases at least 85, and in some cases at least 90 or 95 percent of light emitted from the second lighting device will contact the illumination surface within a second rectangular area defined by the first line segment, a fifth line segment, a sixth line segment and a seventh line segment;

at least 50, in some cases at least 75, in some cases at least 85, and in some cases at least 90 or 95 percent of light emitted from the third lighting device will contact the illumination surface within a third rectangular area defined by the second line segment, an eighth line segment, a ninth line segment and a tenth line segment;

at least 50, in some cases at least 75, in some cases at least 85, and in some cases at least 90 or 95 percent of light emitted from the fourth lighting device will contact the illumination surface within a fourth rectangular area defined by the third line segment, an eleventh line segment, a twelfth line segment and a thirteenth line segment;

at least 50, in some cases at least 75, in some cases at least 85, and in some cases at least 90 or 95 percent of light emitted from the fifth lighting device will contact the illumination surface within a fifth rectangular area defined by the fourth line segment, a fourteenth line segment, a fifteenth line segment and a sixteenth line segment.

Persons of skill in the art are familiar with, and have ready access to, a wide variety of patterned diffusers. Such patterned diffusers are also sometimes referred to as "engineered diffusers." Any desired patterned diffuser can be employed in the lighting devices and methods of the present inventive subject matter. Such patterned diffusers include optical features, such that a substantial portion, e.g., at least 50%, at least 60%, at least 70%, in some cases at least 80% or at least 90%, and in some cases at least 95% or 99%, of the light which enters the patterned diffuser exits the patterned diffuser within a pattern such that a projected pattern (e.g., a square, a rectangle, a hexagon, an octagon, etc.) of the emitted light would be produced (regardless of the pattern of the light which enters the patterned diffuser) on a structure having a flat surface positioned in the path of the emitted light and substantially perpendicular to the path of the at least a portion of emitted light.

Representative examples of such commercially available patterned diffusers include those marketed by RPC Photonics.

According to a second aspect of the present inventive subject matter, there is provided a lighting assembly comprising:

at least first, second, third, fourth and fifth lighting devices, each of the first, second, third, fourth and fifth lighting devices comprising at least one patterned diffuser, each of the patterned diffusers comprising a plurality of optical features, wherein each of the first, second, third, fourth and fifth lighting devices is positioned relative to each other such that if each of the first, second, third, fourth and fifth lighting devices is illuminated and an illumination surface is positioned such that at least a portion of light emitted from each of the first, second, third, fourth and fifth lighting devices travels in a direction substantially perpendicular to the illumination surface:

at least 50, in some cases at least 75, in some cases at least 85, and in some cases at least 90 or 95 percent of light emitted from the first lighting device will contact the illumination surface within a first square area defined by a first line segment, a second line segment, a third line segment and a fourth line segment;

at least 50, in some cases at least 75, in some cases at least 85, and in some cases at least 90 or 95 percent of light emitted from the second lighting device will contact the illumination surface within a second square area defined by the first line segment, a fifth line segment, a sixth line segment and a seventh line segment;

at least 50, in some cases at least 75, in some cases at least 85, and in some cases at least 90 or 95 percent of light emitted from the third lighting device will contact the illumination surface within a third square area defined by the second line segment, an eighth line segment, a ninth line segment and a tenth line segment;

at least 50, in some cases at least 75, in some cases at least 85, and in some cases at least 90 or 95 percent of light emitted from the fourth lighting device will contact the illumination surface within a fourth square area defined by the third line segment, an eleventh line segment, a twelfth line segment and a thirteenth line segment;

at least 50, in some cases at least 75, in some cases at least 85, and in some cases at least 90 or 95 percent of light emitted from the fifth lighting device will contact the illumination surface within a fifth square area defined by the fourth line segment, a fourteenth line segment, a fifteenth line segment and a sixteenth line segment.

According to a third aspect of the present inventive subject matter, there is provided a lighting assembly comprising:

at least first, second, third, fourth, fifth, sixth and seventh lighting devices, each of the first, second, third, fourth, fifth, sixth and seventh lighting devices comprising at least one patterned diffuser, each of the patterned diffusers comprising a plurality of optical features, wherein each of the first, second, third, fourth, fifth, sixth and seventh lighting devices is positioned relative to each other such that if each of the first, second, third, fourth, fifth, sixth and seventh lighting devices is illuminated and an illumination surface is positioned such that at least a portion of light emitted from each of the first, second, third, fourth, fifth, sixth and seventh lighting devices travels in a direction substantially perpendicular to the illumination surface:

at least 50, in some cases at least 75, in some cases at least 85, and in some cases at least 90 or 95 percent of light emitted from the first lighting device will contact the illumination surface within a first hexagonal area defined by a first line segment, a second line segment, a third line segment, a fourth line segment, a fifth line segment and a sixth line segment; at least 50, in some cases at least 75, in some cases at least 85, and in some cases at least 90 or 95 percent of light emitted from the second lighting device will contact the illumination surface within a second hexagonal area defined by the first line segment, a seventh line segment, an eighth line segment, a ninth line segment, a tenth line segment and an eleventh line segment;

at least 50, in some cases at least 75, in some cases at least 85, and in some cases at least 90 or 95 percent of light emitted from the third lighting device will contact the illumination surface within a third hexagonal area defined by the second line segment, a twelfth line segment, a thirteenth line segment, a fourteenth line segment, a fifteenth line segment and a sixteenth line segment;

at least 50, in some cases at least 75, in some cases at least 85, and in some cases at least 90 or 95 percent of light emitted from the fourth lighting device will contact the illumination surface within a fourth hexagonal area defined by the third line segment, a seventeenth line segment, an eighteenth line segment, a nineteenth line segment, a twentieth line segment and a twenty-first line segment;

at least 50, in some cases at least 75, in some cases at least 85, and in some cases at least 90 or 95 percent of light emitted from the fifth lighting device will contact the illumination surface within a fifth hexagonal area defined by the fourth line segment, a twenty-second line segment, a twenty-third line segment, a twenty-fourth line segment, a twenty-fifth line segment and a twenty-sixth line segment;

at least 50, in some cases at least 75, in some cases at least 85, and in some cases at least 90 or 95 percent of light emitted from the sixth lighting device will contact the illumination surface within a sixth hexagonal area defined by the fifth line segment, a twenty-seventh line segment, a twenty-eighth line segment, a twenty-ninth line segment, a thirtieth line segment and a thirty-first line segment;

at least 50, in some cases at least 75, in some cases at least 85, and in some cases at least 90 or 95 percent of light emitted from the seventh lighting device will contact the illumination surface within a seventh hexagonal area defined by the sixth line segment, a thirty-second line segment, a thirty-third line segment, a thirty-fourth line segment, a thirty-fifth line segment and a thirty-sixth line segment.

According to a fourth aspect of the present inventive subject matter, there is provided a lighting assembly comprising:

at least first, second, third, fourth, fifth, sixth, seventh, eighth and ninth lighting devices, each of the first, second, third, fourth, fifth, sixth, seventh, eighth and ninth lighting devices comprising at least one patterned diffuser, each of the patterned diffusers comprising a plurality of optical features, wherein each of the first, second, third, fourth, fifth, sixth, seventh, eighth and ninth lighting devices is positioned relative to each other such that if each of the first, second, third, fourth, fifth, sixth, seventh, eighth and ninth lighting devices is illuminated and an illumination surface is positioned such that at least a portion of light emitted from each of the first, second, third, fourth, fifth, sixth, seventh, eighth and ninth lighting devices travels in a direction substantially perpendicular to the illumination surface:

at least 50, in some cases at least 75, in some cases at least 85, and in some cases at least 90 or 95 percent of light emitted from the first lighting device will contact the illumination surface within a first octagonal area defined by a first line segment, a second line segment, a third line segment, a fourth line segment, a fifth line segment, a sixth line segment, a seventh line segment and an eighth line segment;

at least 50, in some cases at least 75, in some cases at least 85, and in some cases at least 90 or 95 percent of light emitted from the second lighting device will contact the illumination surface within a first square area defined by the first line segment, a ninth line segment, a tenth line segment and an eleventh line segment; at least 50, in some cases at least 75, in some cases at least 85, and in some cases at least 90 or 95 percent of light emitted from the third lighting device will contact the illumination surface within a second octagonal area defined by the second line segment, a twelfth line segment, a thirteenth line segment, a fourteenth line segment, a fifteenth line segment, a sixteenth line segment, a seventeenth line segment and an eighteenth line segment;

at least 50, in some cases at least 75, in some cases at least 85, and in some cases at least 90 or 95 percent of light emitted from the fourth lighting device will contact the illumination surface within a second square area defined by the third line segment, a nineteenth line segment, a twentieth line segment and a twenty-first line segment;

at least 50, in some cases at least 75, in some cases at least 85, and in some cases at least 90 or 95 percent of light emitted from the fifth lighting device will contact the illumination surface within a third octagonal area defined by the fourth line segment, a twenty-second line segment, a twenty-third line segment, a twenty-fourth line segment, a twenty-fifth line segment, a twenty-sixth line segment, a twenty-seventh line segment and a twenty-eighth line segment;

at least 50, in some cases at least 75, in some cases at least 85, and in some cases at least 90 or 95 percent of light emitted from the sixth lighting device will contact the illumination surface within a third square area defined by the fifth line segment, a twenty-ninth line segment, a thirtieth line segment and a thirty-first line segment;

at least 50, in some cases at least 75, in some cases at least 85, and in some cases at least 90 or 95 percent of light emitted from the seventh lighting device will contact the illumination surface within a fourth octagonal area defined by the sixth line segment, a thirty-second line segment, a thirty-third line segment, a thirty-fourth line segment, a thirty-fifth line segment, a thirty-sixth line segment, a thirty-seventh line segment and a thirty-eighth line segment;

at least 50, in some cases at least 75, in some cases at least 85, and in some cases at least 90 or 95 percent of light emitted from the eighth lighting device will contact the illumination surface within a fourth square area defined by the seventh line segment, a thirty-ninth line segment, a fortieth line segment and a forty-first line segment;

at least 50, in some cases at least 75, in some cases at least 85, and in some cases at least 90 or 95 percent of light emitted from the ninth lighting device will contact the illumination surface within a fifth octagonal area defined by the eighth line segment, a forty-second line segment, a forty-third line segment, a forty-fourth line segment, a forty-fifth line segment, a forty-sixth line segment, a forty-seventh line segment and a forty-eighth line segment.

According to a fifth aspect of the present inventive subject matter, there is provided a method of lighting comprising:

illuminating at least first, second, third, fourth and fifth lighting devices, each of the first, second, third, fourth and fifth lighting devices comprising at least one patterned diffuser, each of the patterned diffusers comprising a plurality of optical features, wherein each of the first, second, third, fourth and fifth lighting devices is positioned relative to each other such that:

at least 50, in some cases at least 75, in some cases at least 85, and in some cases at least 90 or 95 percent of light emitted from the first lighting device contacts an illumination surface within a first rectangular area defined by a first line segment, a second line segment, a third line segment and a fourth line segment;

at least 50, in some cases at least 75, in some cases at least 85, and in some cases at least 90 or 95 percent of light emitted from the second lighting device contacts the illumination surface within a second rectangular area defined by the first line segment, a fifth line segment, a sixth line segment and a seventh line segment;

at least 50, in some cases at least 75, in some cases at least 85, and in some cases at least 90 or 95 percent of light emitted from the third lighting device contacts the illumination surface within a third rectangular area defined by the second line segment, an eighth line segment, a ninth line segment and a tenth line segment;

at least 50, in some cases at least 75, in some cases at least 85, and in some cases at least 90 or 95 percent of light emitted from the fourth lighting device contacts the illumination surface within a fourth rectangular area defined by the third line segment, an eleventh line segment, a twelfth line segment and a thirteenth line segment;

at least 50, in some cases at least 75, in some cases at least 85, and in some cases at least 90 or 95 percent of light emitted from the fifth lighting device contacts the illumination surface within a fifth rectangular area defined by the fourth line segment, a fourteenth line segment, a fifteenth line segment and a sixteenth line segment.

According to a sixth aspect of the present inventive subject matter, there is provided a method of lighting comprising:

illuminating at least first, second, third, fourth and fifth lighting devices, each of the first, second, third, fourth and fifth lighting devices comprising at least one patterned diffuser, each of the patterned diffusers comprising a plurality of optical features, wherein each of the first, second, third, fourth and fifth lighting devices is positioned relative to each other such that:

at least 50, in some cases at least 75, in some cases at least 85, and in some cases at least 90 or 95 percent of light emitted from the first lighting device contacts an illumination surface within a first square area defined by a first line segment, a second line segment, a third line segment and a fourth line segment;

at least 50, in some cases at least 75, in some cases at least 85, and in some cases at least 90 or 95 percent of light emitted from the second lighting device contacts the illumination surface within a second square area defined by the first line segment, a fifth line segment, a sixth line segment and a seventh line segment;

at least 50, in some cases at least 75, in some cases at least 85, and in some cases at least 90 or 95 percent of light emitted from the third lighting device contacts the illumination surface within a third square area defined by the second line segment, an eighth line segment, a ninth line segment and a tenth line segment;

at least 50, in some cases at least 75, in some cases at least 85, and in some cases at least 90 or 95 percent of light emitted from the fourth lighting device contacts the illumination surface within a fourth square area defined by the third line segment, an eleventh line segment, a twelfth line segment and a thirteenth line segment;

at least 50, in some cases at least 75, in some cases at least 85, and in some cases at least 90 or 95 percent of light emitted from the fifth lighting device contacts the illumination surface within a fifth square area defined by the fourth line segment, a fourteenth line segment, a fifteenth line segment and a sixteenth line segment.

According to a seventh aspect of the present inventive subject matter, there is provided a method of lighting comprising:

illuminating at least first, second, third, fourth, fifth, sixth and seventh lighting devices, each of the first, second, third, fourth, fifth, sixth and seventh lighting devices comprising at least one patterned diffuser, each of the patterned diffusers comprising a plurality of optical features, wherein each of the first, second, third, fourth, fifth, sixth and seventh lighting devices is positioned relative to each other such that:

at least 50, in some cases at least 75, in some cases at least 85, and in some cases at least 90 or 95 percent of light emitted from the first lighting device contacts an illumination surface within a first hexagonal area defined by a first line segment, a second line segment, a third line segment, a fourth line segment, a fifth line segment and a sixth line segment;

at least 50, in some cases at least 75, in some cases at least 85, and in some cases at least 90 or 95 percent of light emitted from the second lighting device contacts the illumination surface within a second hexagonal area defined by the first line segment, a seventh line segment, an eighth line segment, a ninth line segment, a tenth line segment and an eleventh line segment;

at least 50, in some cases at least 75, in some cases at least 85, and in some cases at least 90 or 95 percent of light emitted from the third lighting device contacts the illumination surface within a third hexagonal area defined by the second line segment, a twelfth line segment, a thirteenth line segment, a fourteenth line segment, a fifteenth line segment and a sixteenth line segment;

at least 50, in some cases at least 75, in some cases at least 85, and in some cases at least 90 or 95 percent of light emitted from the fourth lighting device contacts the illumination surface within a fourth hexagonal area defined by the third line segment, a seventeenth line segment, an eighteenth line segment, a nineteenth line segment, a twentieth line segment and a twenty-first line segment;

at least 50, in some cases at least 75, in some cases at least 85, and in some cases at least 90 or 95 percent of light emitted from the fifth lighting device contacts the illumination surface within a fifth hexagonal area defined by the fourth line segment, a twenty-second line segment, a twenty-third line segment, a twenty-fourth line segment, a twenty-fifth line segment and a twenty-sixth line segment;

at least 50, in some cases at least 75, in some cases at least 85, and in some cases at least 90 or 95 percent of light emitted from the sixth lighting device contacts the illumination surface within a sixth hexagonal area defined by the fifth line segment, a twenty-seventh line segment, a twenty-eighth line segment, a twenty-ninth line segment, a thirtieth line segment and a thirty-first line segment;

at least 50, in some cases at least 75, in some cases at least 85, and in some cases at least 90 or 95 percent of light emitted from the seventh lighting device contacts the illumination surface within a seventh hexagonal area defined by the sixth line segment, a thirty-second line segment, a thirty-third line segment, a thirty-fourth line segment, a thirty-fifth line segment and a thirty-sixth line segment.

According to an eighth aspect of the present inventive subject matter, there is provided a method of lighting comprising:

illuminating at least first, second, third, fourth, fifth, sixth, seventh, eighth and ninth lighting devices, each of the first, second, third, fourth, fifth, sixth, seventh, eighth and ninth lighting devices comprising at least one patterned diffuser, each of the patterned diffusers comprising a plurality of optical features, wherein each of the first, second, third, fourth, fifth, sixth, seventh, eighth and ninth lighting devices is positioned relative to each other such that:

at least 50, in some cases at least 75, in some cases at least 85, and in some cases at least 90 or 95 percent of light emitted from the first lighting device contacts an illumination surface within a first octagonal area defined by a first line segment, a second line segment, a third line segment, a fourth line segment, a fifth line segment, a sixth line segment, a seventh line segment and an eighth line segment;

at least 50, in some cases at least 75, in some cases at least 85, and in some cases at least 90 or 95 percent of light emitted from the second lighting device contacts the illumination surface within a first square area defined by the first line segment, a ninth line segment, a tenth line segment and an eleventh line segment;

at least 50, in some cases at least 75, in some cases at least 85, and in some cases at least 90 or 95 percent of light emitted from the third lighting device contacts the illumination surface within a second octagonal area defined by the second line segment, a twelfth line segment, a thirteenth line segment, a fourteenth line segment, a fifteenth line segment, a sixteenth line segment, a seventeenth line segment and an eighteenth line segment;

at least 50, in some cases at least 75, in some cases at least 85, and in some cases at least 90 or 95 percent of light emitted from the fourth lighting device contacts the illumination surface within a second square area defined by the third line segment, a nineteenth line segment, a twentieth line segment and a twenty-first line segment;

at least 50, in some cases at least 75, in some cases at least 85, and in some cases at least 90 or 95 percent of light emitted from the fifth lighting device contacts the illumination surface within a third octagonal area defined by the fourth line segment, a twenty-second line segment, a twenty-third line segment, a twenty-fourth line segment, a twenty-fifth line segment, a twenty-sixth line segment, a twenty-seventh line segment and a twenty-eighth line segment;

at least 50, in some cases at least 75, in some cases at least 85, and in some cases at least 90 or 95 percent of light emitted from the sixth lighting device contacts the illumination surface within a third square area defined by the fifth line segment, a twenty-ninth line segment, a thirtieth line segment and a thirty-first line segment;

at least 50, in some cases at least 75, in some cases at least 85, and in some cases at least 90 or 95 percent of light emitted from the seventh lighting device contacts the illumination surface within a fourth octagonal area defined by the sixth line segment, a thirty-second line segment, a thirty-third line segment, a thirty-fourth line segment, a thirty-fifth line segment, a thirty-sixth line segment, a thirty-seventh line segment and a thirty-eighth line segment;

at least 50, in some cases at least 75, in some cases at least 85, and in some cases at least 90 or 95 percent of light emitted from the eighth lighting device contacts the illumination surface within a fourth square area defined by the seventh line segment, a thirty-ninth line segment, a fortieth line segment and a forty-first line segment;

at least 50, in some cases at least 75, in some cases at least 85, and in some cases at least 90 or 95 percent of light emitted from the ninth lighting device contacts the illumination surface within a fifth octagonal area defined by the eighth line segment, a forty-second line segment, a forty-third line segment, a forty-fourth line segment, a forty-fifth line segment, a forty-sixth line segment, a forty-seventh line segment and a forty-eighth line segment.

By providing lighting devices as described above and arranged as described above, the respective areas of a surface illuminated by the respective lighting devices abut one another without a large proportion of the light overlapping into adjacent areas, enabling more uniform illumination of the surface.

In some embodiments according to the present inventive subject matter, at least one of the lighting devices comprises at least one solid state light emitter.

In some embodiments according to the present inventive subject matter, the light emitted by a light source in the first lighting device enters a first patterned diffuser in the first lighting device through a first surface of the first patterned diffuser and exits the first patterned diffuser through a second surface of the first patterned diffuser. In some such embodiments, a plurality of optical features are positioned on the first surface of the first patterned diffuser.

The inventive subject matter may be more fully understood with reference to the accompanying drawings and the following detailed description of the inventive subject matter.

BRIEF DESCRIPTION OF THE DRAWING FIGURE

FIG. 1 is a sectional view of a first embodiment of a lighting device according to the present inventive subject matter.

Figure 2:
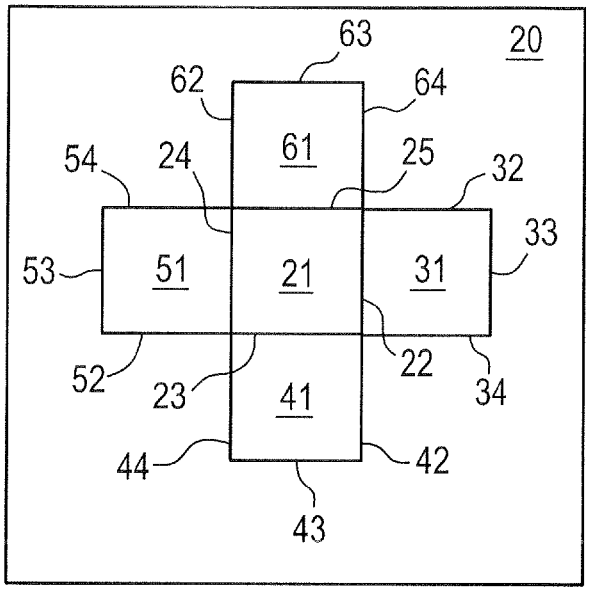

FIG. 2 schematically depicts patterns of light on an illumination surface, the light emitted by first, second, third, fourth and fifth lighting devices in a lighting assembly comprising the first, second, third, fourth and fifth lighting devices and first, second, third, fourth and fifth patterned diffusers.

Figure 3:
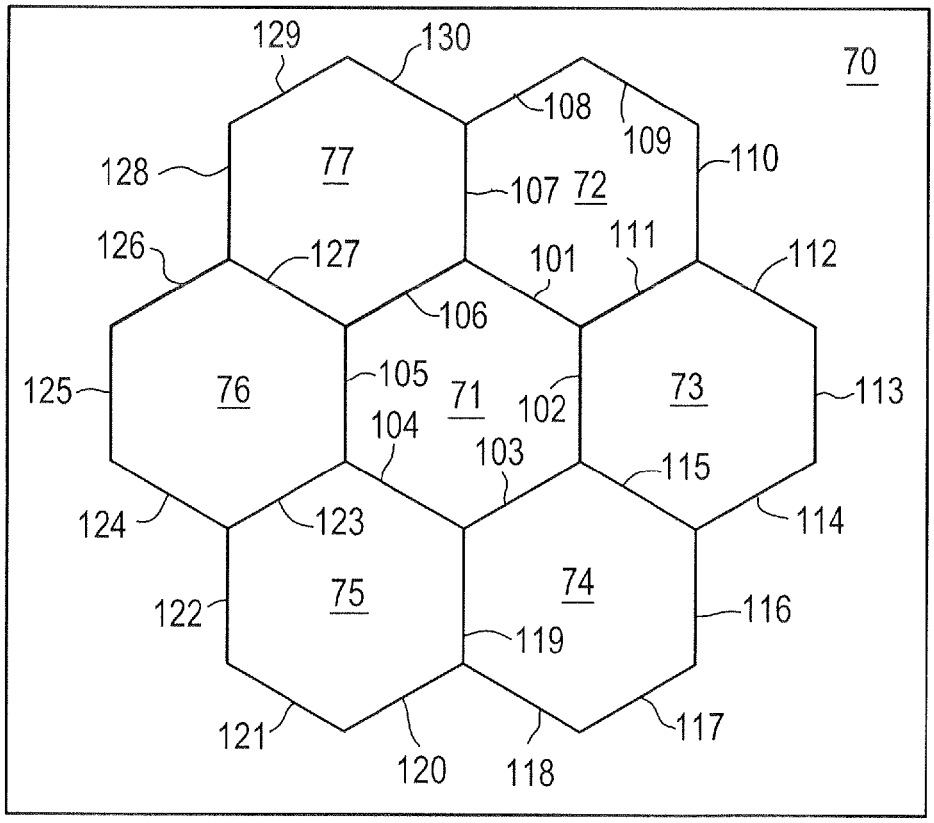

FIG. 3 schematically depicts patterns of light on an illumination surface, the light emitted by first, second, third, fourth, fifth, sixth and seventh lighting devices in a lighting assembly comprising the first, second, third, fourth, fifth, sixth and seventh lighting devices and first, second, third, fourth, fifth, sixth and seventh patterned diffusers.

Figure 4:
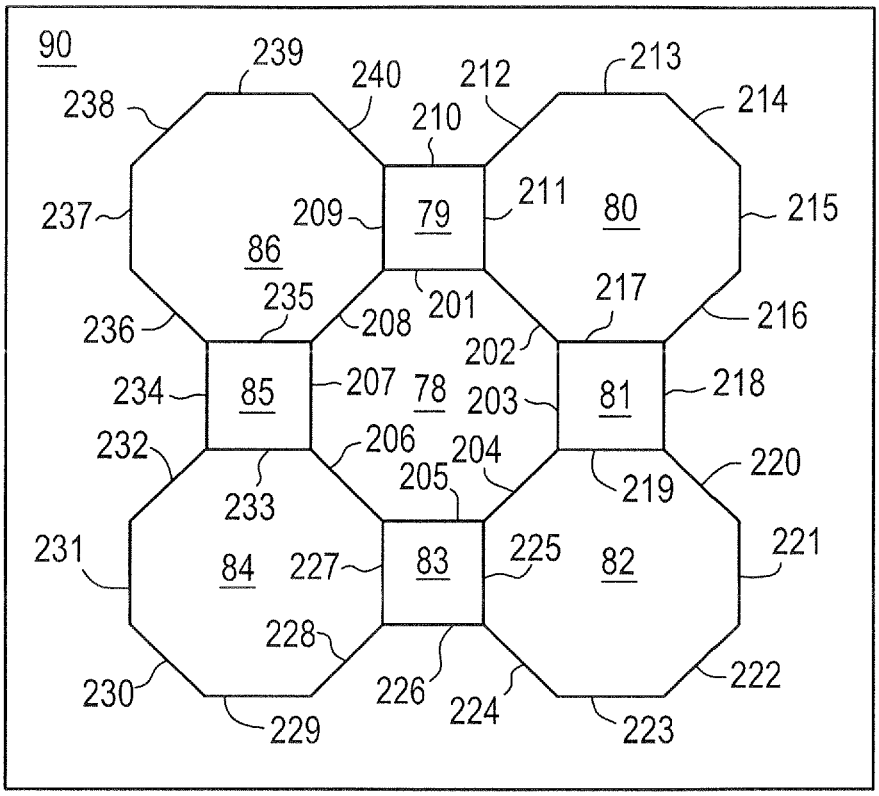

FIG. 4 schematically depicts patterns of light on an illumination surface, the light emitted by first, second, third, fourth, fifth, sixth, seventh and eighth lighting devices in a lighting assembly comprising the first, second, third, fourth, fifth, sixth, seventh and eighth lighting devices and first, second, third, fourth, fifth, sixth, seventh and eighth patterned diffusers.

Figure 5:
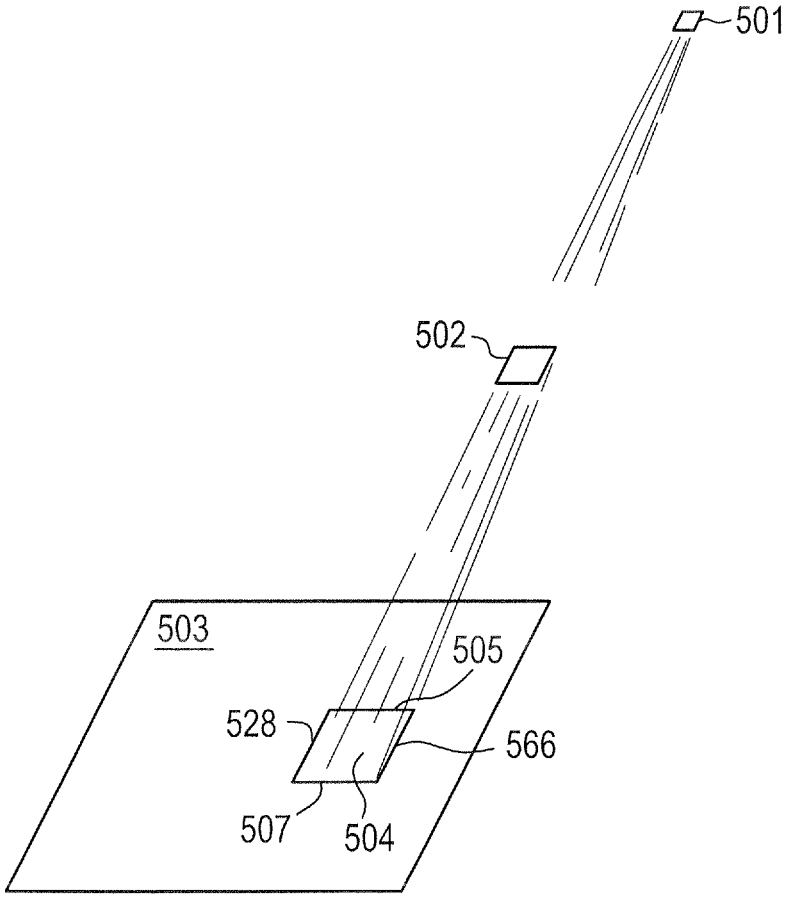

FIG. 5 schematically depicts an arrangement that comprises a first lighting device, a first patterned diffuser and an illumination surface.

Figure 6:
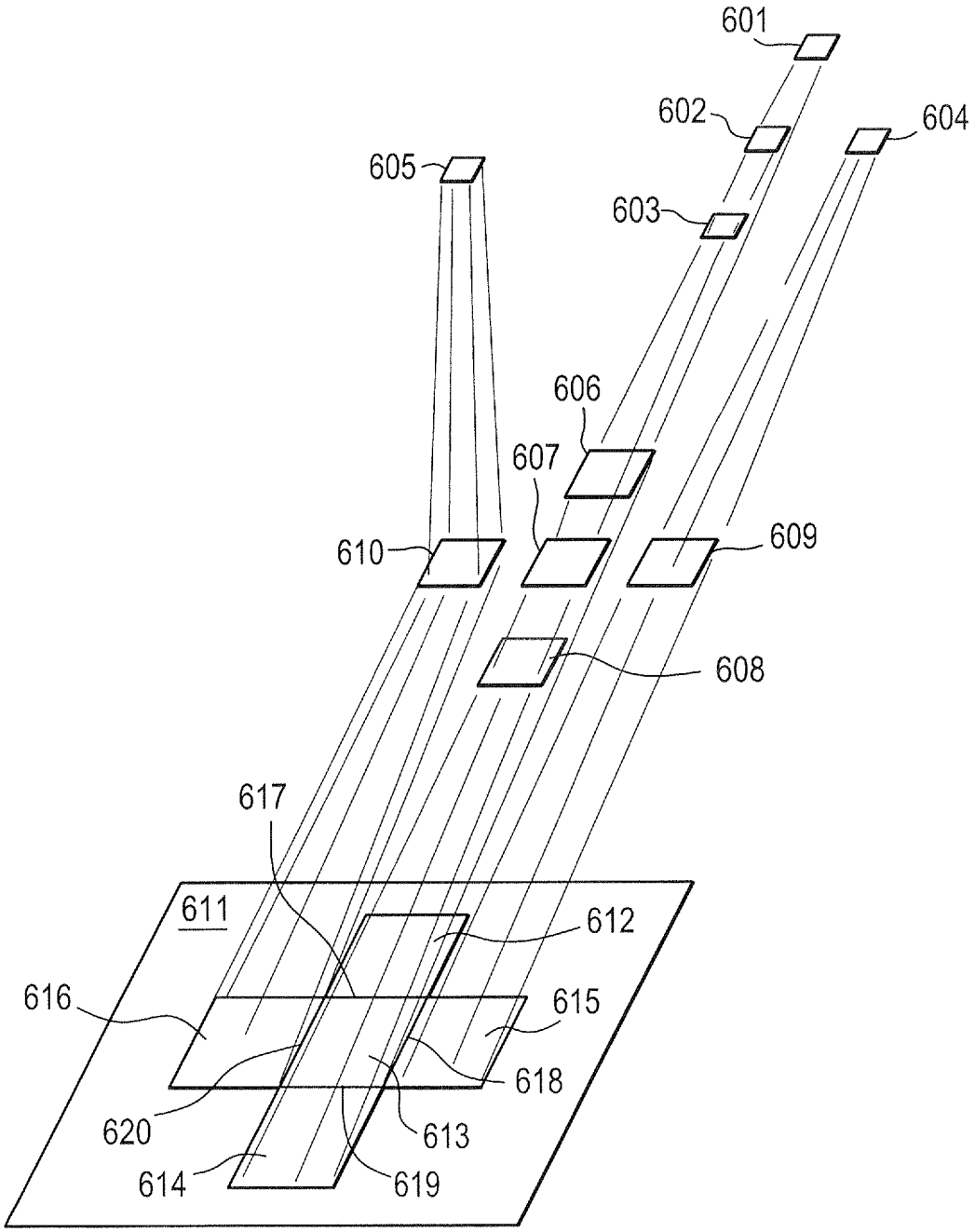

FIG. 6 schematically depicts an arrangement that comprises a first lighting device, a second lighting device, a third lighting device, a fourth lighting device, a fifth lighting device, a first patterned diffuser, a second patterned diffuser, a third patterned diffuser, a fourth patterned diffuser, a fifth patterned diffuser and an illumination surface.

DETAILED DESCRIPTION OF THE INVENTION(S)

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Furthermore, relative terms, such as "lower" or "bottom" and "upper" or "top," may be used herein to describe one element's relationship to another elements as illustrated in the FIGURE. Such relative terms are intended to encompass different orientations of the device in addition to the orientation depicted in the FIGURE. For example, if the device in the FIGURE is turned over, elements described as being on the "lower" side of other elements would then be oriented on "upper" sides of the other elements. The exemplary term "lower", can therefore, encompass both an orientation of "lower" and "upper," depending on the particular orientation of the FIGURE. Similarly, if the device in the FIGURE is turned over, elements described as "below" or "beneath" other elements would then be oriented "above" the other elements. The exemplary terms "below" or "beneath" can, therefore, encompass both an orientation of above and below.

The expression "illumination" (or "illuminated"), as used herein when referring to a solid state light emitter, means that at least some current is being supplied to the solid state light emitter to cause the solid state light emitter to emit at least some light. The expression "illuminated" encompasses situations where the solid state light emitter emits light continuously or intermittently at a rate such that a human eye would perceive it as emitting light continuously, or where a plurality of solid state light emitters of the same color or different colors are emitting light intermittently and/or alternatingly (with or without overlap in "on" times) in such a way that a human eye would perceive them as emitting light continuously (and, in cases where different colors are emitted, as a mixture of those colors).

The expression "excited", as used herein when referring to a lumiphor, means that at least some electromagnetic radiation (e.g., visible light, Uv light or infrared light) is contacting the lumiphor, causing the lumiphor to emit at least some light. The expression "excited" encompasses situations where the lumiphor emits light continuously or , intermittently at a-rate such that a human eye would perceive it as emitting light continuously, or where a plurality of lumiphors of the same color or different colors are emitting light intermittently and/or alternatingly (with or without overlap in "on" times) in such a way that a human eye would perceive them as emitting light continuously (and, in cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The expression "substantially perpendicular", as used herein, means that at least 90% of the points in the item which is characterized as being substantially perpendicular to a reference plane or line are located on one of or between a pair of planes (1) which are perpendicular to the reference plane, (2) which are parallel to each other and (3) which are spaced from each other by a distance of not more than 10% of the largest dimension of the structure.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, according to the present inventive subject matter, there are provided lighting assemblies comprising lighting devices which comprise patterned diffusers, as well as methods of lighting comprising illuminating lighting devices which comprise patterned diffusers.

Any desired lighting devices can be employed in accordance with the present inventive subject matter. Persons of skill in the art are aware of, and have ready access to, a wide variety of such lighting devices.

One representative type of lighting device which is suitable for use according to the present inventive subject matter is solid state light emitters. Such solid state light emitters include inorganic and organic light emitters. Examples of types of such light emitters include a wide variety of light emitting diodes (inorganic or organic, including polymer light emitting diodes (PLEDs)), laser diodes, thin film electroluminescent devices, light emitting polymers (LEPs), a variety of each of which are well-known in the art (and therefore it is not necessary to describe in detail such devices, and/or the materials out of which such devices are made).

Where more than one solid state light emitter is employed, the respective light emitters can be similar to one another, different from one another or any combination (i.e., there can be a plurality of solid state light emitters of one type, or one or more solid state light emitters of each of two or more types)

The lighting devices according to the present inventive subject matter can comprise any desired number of solid state emitters. For example, a lighting device according to the present inventive subject matter can include one or more light emitting diodes, 50 or more light emitting diodes, or 100 or more light emitting diodes, etc.

In some embodiments according to the present inventive subject matter, the lighting device farther comprises at least one lumiphor (i.e., luminescence region or luminescent element which comprises at least one luminescent material). The expression "lumiphor", as used herein, refers to any luminescent element, i.e., any element which includes a luminescent material.

The one or more lumiphors, when provided, can individually be any lumiphor, a wide variety of which are known to those skilled in the art. For example, the one or more luminescent materials in the lumiphor can be selected from among phosphors, scintillators, day glow tapes, inks which glow in the visible spectrum upon illumination with ultraviolet light, etc. The one or more luminescent materials can be down-converting or up-converting, or can include a combination of both types. For example, the first lumiphor can comprise one or more down-converting luminescent materials.

The (or each of the) one or more lumiphor(s) can, if desired, further comprise (or consist essentially of, or consist of) one or more highly transmissive (e.g., transparent or substantially transparent, or somewhat diffuse) binder, e.g., made of epoxy, silicone, glass, metal oxide or any other suitable material (for example, in any given lumiphor comprising one or more binder, one or more phosphor can be dispersed within the one or more binder). In general, the thicker the lumiphor, the lower the weight percentage of the phosphor can be. Representative examples of the weight percentage of phosphor include from about 3.3 weight percent up to about 20 weight percent, although, as indicated above, depending on the overall thickness of the lumiphor, the weight percentage of the phosphor could be generally any value, e.g., from 0.1 weight percent to 100 weight percent (e.g., a lumiphor formed by subjecting pure phosphor to a hot isostatic pressing procedure).

Devices in which a lumiphor is provided can, if desired, further comprise one or more clear encapsulant (comprising, e.g., one or more silicone materials) positioned between the solid state light emitter (e.g., light emitting diode) and the lumiphor.

For example, light emitting diodes and lumiphors which may be used in practicing the present inventive subject matter are described in:

(1) U.S. Patent Application No. 60/753,138, filed on Dec. 22, 2005, entitled "Lighting Device" (inventor: Gerald H. Negley) and U.S. patent application Ser. No. 11/614,180, filed Dec. 21, 2006 (now U.S. Patent Publication No. 2007/0236911), the entireties of which are hereby incorporated by reference;

(2) U.S. Patent Application No. 60/794,379, filed on Apr. 24, 2006, entitled "Shifting Spectral Content in LEDs by Spatially Separating Lumiphor Films" (inventors: Gerald H. Negley and Antony Paul van de Ven) and U.S. patent application Ser. No. 11/624,811, filed Jan. 19, 2007 (now U.S. Patent Publication No. 2007/0170447), the entireties of which are hereby incorporated by reference;

(3) U.S. Patent Application No. 60/808,702, filed on May 26, 2006, entitled "Lighting Device" (inventors: Gerald H. Negley and Antony Paul van de Ven) and U.S. patent application Ser. No. 11/751,982, filed May 22, 2007 (now U.S. Patent Publication No. 2007/0274080), the entireties of which are hereby incorporated by reference;

(4) U.S. Patent Application No. 60/808,925, filed on May 26, 2006, entitled "Solid State Light Emitting Device and Method of Making Same" (inventors: Gerald H. Negley and Neal Hunter) and U.S. patent application Ser. No. 11/753, 103, filed May 24, 2007 (now U.S. Patent Publication No. 2007/0280624), the entireties of which are hereby incorporated by reference;

(5) U.S. Patent Application No. 60/802,697, filed on May 23, 2006, entitled "Lighting Device and Method of Making" (inventor: Gerald H. Negley) and U.S. patent application Ser. No. 11/751,990, filed May 22. 2007 (now U.S. Patent Publication No. 2007/0274063), the entireties of which are hereby incorporated by reference;

(6) U.S. Patent Application No. 60/839,453, filed on Aug. 23, 2006, entitled "LIGHTING DEVICE AND LIGHTING METHOD" (inventors: Antony Paul van de Ven and Gerald H. Negley) and U.S. patent application Ser. No. 11/843,243, filed Aug. 22, 2007 (now U.S. Patent Publication No. 2008/0084685), the entireties of which are hereby incorporated by reference;

(7) U.S. Patent Application No. 60/857,305, filed on Nov. 7, 2006, entitled "LIGHTING DEVICE AND LIGHTING METHOD" (inventors: Antony Paul van de Ven and Gerald H. Negley, the entirety of which is hereby incorporated by reference; and (8) U.S. Patent Application No. 60/851,230, filed on Oct. 12, 2006, entitled "LIGHTING DEVICE AND METHOD OF MAKING SAME" (inventor: Gerald H. Negley; the entirety of which is hereby incorporated by reference.

The lighting devices of the present inventive subject matter can be arranged, mounted and supplied with electricity in any desired manner, and can be mounted on any desired housing or fixture. Skilled artisans are familiar with a wide variety of arrangements, mounting schemes, power supplying apparatuses, housings and fixtures, and any such arrangements, schemes, apparatuses, housings and fixtures can be employed in connection with the present inventive subject matter. The lighting devices of the present inventive subject matter can be electrically connected (or selectively connected) to any desired power source, persons of skill in the art being familiar with a variety of such power sources.

Representative examples of arrangements of sources of visible light, mounting structures, schemes for mounting sources of visible light, apparatus for supplying electricity to sources of visible light, housings for sources of visible light, fixtures for sources of visible light, power supplies for sources of visible light and complete lighting assemblies, all of which are suitable for the lighting devices of the present inventive subject matter, are described in:

(1) U.S. Patent Application No. 60/752,753, filed on Dec. 21, 2005, entitled "Lighting Device" (inventors: Gerald H. Negley, Antony Paul van de Ven and Neal Hunter) and U.S. patent application Ser. No. 11/613,692, filed Dec. 20, 2006 (now U.S. Patent Publication No. 2007/0139923), the entireties of which are hereby incorporated by reference;

(2) U.S. Patent Application No. 60/798,446, filed on May 5, 2006, entitled "Lighting Device" (inventor: Antony Paul van de Ven) and U.S. patent application Ser. No. 11/743,754, filed May 3, 2007 (now U.S. Patent Publication No. 2007/0263393), the entireties of which are hereby incorporated by reference;

(3) U.S. Patent Application No. 60/845,429, filed on Sep. 18, 2006, entitled "LIGHTING DEVICES, LIGHTING ASSEMBLIES, FIXTURES AND METHODS OF USING SAME" (inventor: Antony Paul van de Ven, and U.S. patent application Ser. No. 11/856,421, filed Sep. 17, 2007 (now U.S. Patent Publication No. 2008/0084700), the entireties of which are hereby incorporated by reference;

(4) U.S. Patent Application No. 60/846,222, filed on Sep. 21, 2006, entitled "LIGHTING ASSEMBLIES, METHODS OF INSTALLING SAME, AND METHODS OF REPLACING LIGHTS" (inventors: Antony Paul van de Ven and Gerald H. Negley), and U.S. patent application Ser. No. 11/859,048, filed Sep. 21, 2007 (now U.S. Patent Publication No. 2008/0084701), the entireties of which are hereby incorporated by reference;

(5) U.S. Patent Application No. 60/809,618, filed on May 31, 2006, entitled "LIGHTING DEVICE AND METHOD OF LIGHTING" (inventors: Gerald H. Negley, Antony Paul van de Ven and Thomas G. Coleman) and U.S. patent application Ser. No. 11/755,153, filed May 30, 2007 (now U.S. Patent Publication No. 2007/0279903), the entireties of which are hereby incorporated by reference;

(6) U.S. Patent Application No. 60/858,558, filed on Nov. 13, 2006, entitled "LIGHTING DEVICE, ILLUMINATED ENCLOSURE AND LIGHTING METHODS" (inventor: Gerald H. Negley), the entirety of which is hereby incorporated by reference;

(7) U.S. Patent Application No. 60/858,881, filed on Nov. 14, 2006, entitled "LIGHT ENGINE ASSEMBLIES" (inventors: Paul Kenneth Pickard and Gary David Trott), the entirety of which is hereby incorporated by reference;

(8) U.S. Patent Application No. 60/859,013, filed on Nov. 14, 2006, entitled "LIGHTING ASSEMBLIES AND COMPONENTS FOR LIGHTING ASSEMBLIES" (inventors: Gary David Trott and Paul Kenneth Pickard) and U.S. patent application Ser. No. 11/939,059, filed Apr. 18, 2007 (now U.S. Patent Publication No. 2008/0112170), the entireties of which are hereby incorporated by reference; and (9) U.S. Patent Application No. 60/853,589, filed on Oct. 23, 2006, entitled "LIGHTING DEVICES AND METHODS OF INSTALLING LIGHT ENGINE HOUSINGS AND/OR TRIM ELEMENTS IN LIGHTING DEVICE HOUSINGS" (inventors: Gary David Trott and Paul Kenneth Pickard), the entirety of which is hereby incorporated by reference.

Persons skilled in the art are familiar with, and have ready access to, a wide variety of optical elements, any of which is suitable for use in the lighting devices according to the present inventive subject matter.

Embodiments in accordance with the present inventive subject matter are described herein with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the FIGURE are schematic in nature and their shapes are not intended to illustrate the precise shape of a region of a device and are not intended to limit the scope of the present inventive subject matter.

FIG. 1 is a sectional view of a first embodiment of a lighting device according to the present inventive subject matter.

Referring to FIG. 1, there is shown a lighting device which comprises plural solid state lighting devices 16*a* and 16*b* (LEDs in this embodiment), a patterned diffuser 18, a heat spreading element 11, insulating regions 12, a highly reflective surface 13, conductive traces 14 formed on a printed circuit board 28, a lead frame 15 and a reflective cone 17. The LEDs 16*a* and 16*b* are positioned relative to the patterned diffuser 18 such that if the LEDs 16*a* and 16*b* are illuminated so that they emit light, at least some of the light emitted by the LEDs 16*a* and 16*b* enters the patterned diffuser 18 through a first surface 21 and exits the patterned diffuser 18 through a second surface 22, the patterned diffuser 18 comprising a plurality of optical features 23 formed on the first surface 21.

FIG. 2 schematically depicts patterns of light on an illumination surface 20, the light emitted by first, second, third, fourth and fifth lighting devices in a lighting assembly comprising the first, second, third, fourth and fifth lighting devices and first, second, third, fourth and fifth patterned diffusers, the first, second, third, fourth and fifth lighting devices positioned relative to each other such that:

light emitted from the first lighting device contacts the illumination surface within a first square area 21 defined by a first line segment 22, a second line segment 23, a third line segment 24 and a fourth line segment 25;

light emitted from the second lighting device contacts the illumination surface within a second square area 31 defined by said first line segment 22, a fifth line segment 32, a sixth line segment 33 and a seventh line segment 34;

light emitted from the third lighting device contacts the illumination surface within a third square area 41 defined by said second line segment 23, an eighth line segment 42, a ninth line segment 43 and a tenth line segment 44;

light emitted from the fourth lighting device contacts the illumination surface within a fourth square area 51 defined by said third line segment 24, an eleventh line segment 52, a twelfth line segment 53 and a thirteenth line segment 54;

light emitted from the fifth lighting device contacts the illumination surface within a fifth square area 61 defined by said fourth line segment 25, a fourteenth line segment 62, a fifteenth line segment 63 and a sixteenth line segment 64.

FIG. 3 schematically depicts patterns of light on an illumination surface 70, the light emitted by first, second, third, fourth, fifth, sixth and seventh lighting devices in a lighting assembly comprising the first, second, third, fourth, fifth, sixth and seventh lighting devices and first, second, third, fourth, fifth, sixth and seventh patterned diffusers, the first, second, third, fourth, fifth, sixth and seventh lighting devices positioned relative to each other such that:

light emitted from the first lighting device contacts the illumination surface 70 within a first hexagonal area 71 defined by a first line segment 101, a second line segment 102, a third line segment 103, a fourth line segment 104, a fifth line segment 105 and a sixth line segment 106;

light emitted from the second lighting device contacts the illumination surface 70 within a second hexagonal area 72 defined by the first line segment 101, a seventh line segment 107, an eighth line segment 108, a ninth line segment 109, a tenth line segment 110 and an eleventh line segment 111;

light emitted from the third lighting device contacts the illumination surface 70 within a third hexagonal area 73 defined by the second line segment 102, the eleventh line segment 111, a twelfth line segment 112, a thirteenth line segment 113, a fourteenth line segment 114 and a fifteenth line segment 115;

light emitted from the fourth lighting device contacts the illumination surface 70 within a fourth hexagonal area 74 defined by the third line segment 103, the fifteenth line segment 115, a sixteenth line segment 116, a seventeenth line segment 117, an eighteenth line segment 118 and a nineteenth line segment 119;

light emitted from the fifth lighting device contacts the illumination surface 70 within a fifth hexagonal area 75 defined by the fourth line segment 104, the nineteenth line segment 119, a twentieth line segment 120, a twenty-first line segment 121, a twenty-second line segment 122 and a twenty-third line segment 123;

light emitted from the sixth lighting device contacts the illumination surface 70 within a sixth hexagonal area 76 defined by the fifth line segment 105, the twenty-third line segment 123, a twenty-fourth line segment 124, a twenty-fifth line segment 125, a twenty-sixth line segment 126 and a twenty-seventh line segment 127; and light emitted from the seventh lighting device contacts the illumination surface 70 within a seventh hexagonal area 77 defined by the sixth line segment 106, the seventh line segment 107, the twenty-seventh line segment 127, a twenty-eighth line segment 128, a twenty-ninth line segment 129 and a thirtieth line segment 130.

FIG. 4 schematically depicts patterns of light on an illumination surface 90, the light emitted by first, second, third, fourth, fifth, sixth, seventh and eighth lighting devices in a lighting assembly comprising the first, second, third, fourth, fifth, sixth, seventh and eighth lighting devices and first, second, third, fourth, fifth, sixth, seventh and eighth patterned diffusers, the first, second, third, fourth, fifth, sixth, seventh and eighth lighting devices positioned relative to each other such that:

light emitted from the first lighting device contacts the illumination surface 90 within a first octagonal area 78 defined by a first line segment 201, a second line segment 202, a third line segment 203, a fourth line segment 204, a fifth line segment 205, a sixth line segment 206, a seventh line segment 207 and an eighth line segment 208;

light emitted from the second lighting device contacts the illumination surface 90 within a first square area 79 defined by the first line segment 201, a ninth line segment 209, a tenth line segment 210 and an eleventh line segment 211;

light emitted from the third lighting device contacts the illumination surface 90 within a second octagonal area 80 defined by the second line segment 202, the eleventh line segment 211, a twelfth line segment 212, a thirteenth line segment 213, a fourteenth line segment 214, a fifteenth line segment 215, a sixteenth line segment 216 and a seventeenth line segment 217;

light emitted from the fourth lighting device contacts the illumination surface 90 within a second square area 81 defined by the third line segment 203, the seventeenth line segment 217, an eighteenth line segment 218 and a nineteenth line segment 219;

light emitted from the fifth lighting device contacts the illumination surface 90 within a third octagonal area 82 defined by the fourth line segment 204, the nineteenth line segment 219, a twentieth line segment 220, a twenty-first line segment 221, a tewnty-second line segment 222, a twenty-third line segment 223, a twenty-fourth line segment 224 and a twenty-fifth line segment 225;

light emitted from the sixth lighting device contacts the illumination surface 90 within a third square area 83 defined by the fifth line segment 205, the twenty-fifth line segment 225, a twenty-sixth line segment 226 and a twenty-seventh line segment 227;

light emitted from the seventh lighting device contacts the illumination surface 90 within a fourth octagonal area 84 defined by the sixth line segment 206, the twenty-seventh line segment 227, a twenty-eighth line segment 228, a twenty-ninth line segment 229, a thirtieth line segment 230, a thirty-first line segment 231, a thirty-second line segment 232 and a thirty-third line segment 233;

light emitted from the eighth lighting device contacts the illumination surface 90 within a fourth square area 85 defined by the seventh line segment 207, the thirty-third line segment 233, a thirty-fourth line segment 234 and a thirty-fifth line segment 235; and light emitted from the ninth lighting device contacts the illumination surface 90 within a fifth octagonal area 86 defined by the eighth line segment 208, the ninth line segment 209, the thirty-fifth line segment 235, a thirty-sixth line segment 236, a thirty-seventh line segment 237, a thirty-eighth line segment 238, a thirty-ninth line segment 239 and a fortieth line segment 240.

FIG. 5 schematically depicts an arrangement that comprises a first lighting device 501, a first patterned diffuser 502 and an illumination surface 503, in which if the first lighting device is illuminated, the light emitted from the first lighting device 501 enters the patterned diffuser 502, exits the patterned diffuser 502 and contacts the illumination surface 503 within a square area 504 defined by a first line segment 505, a second line segment 506, a third line segment 507 and a fourth line segment 508.

FIG. 6 schematically depicts an arrangement that comprises a first lighting device 601, a second lighting device 602, a third lighting device 603, a fourth lighting device 604, a fifth lighting device 605, a first patterned diffuser 606, a second patterned diffuser 607, a third patterned diffuser 608, a fourth patterned diffuser 609, a fifth patterned diffuser 610 and an illumination surface 611, in which the first lighting device 601, the second lighting device 602, the third lighting device 603, the fourth lighting device 604, the fifth lighting device 605 the first patterned diffuser 606, the second patterned diffuser 607, the third patterned diffuser 608, the fourth patterned diffuser 609, the fifth patterned diffuser 610 and the illumination surface 611 are positioned and oriented relative to one another such that:

light emitted from the first lighting device 601 enters the first patterned diffuser 606, exits the first patterned diffuser 606 and contacts the illumination surface 611 in a first square area 612;

light emitted from the second lighting device 602 enters the second patterned diffuser 607, exits the second patterned diffuser 607 and contacts the illumination surface 611 in a second square area 613;

light emitted from the third lighting device 603 enters the third patterned diffuser 608, exits the first patterned diffuser 608 and contacts the illumination surface 611 in a third square area 614;

light emitted from the fourth lighting device 604 enters the fourth patterned diffuser 609, exits the fourth patterned diffuser 609 and contacts the illumination surface 611 in a fourth square area 615;

light emitted from the fifth lighting device 605 enters the fifth patterned diffuser 610, exits the fifth patterned diffuser 610 and contacts the illumination surface 611 in a fifth square area 616, the second square area 613 having a first side 617, a second side 618, a third side 619 and a fourth side 620, the first square area 613, the third square area 614, the fourth square area 615 and the fifth square area 616 each abutting the second square area 613 such that:

the second square area 613 and the first square area 612 share the first side 617;

the second square area 613 and the third square area 614 share the third side 619;

the second square area 613 and the fourth square area 615 share the second side 618; and the second square area 613 and the fifth square area 616 share the fourth side 620.

Any two or more structural parts of the lighting assemblies described herein can be integrated. Any structural part of the lighting assemblies described herein can be provided in two or more parts which are held together, if necessary. Similarly, any two or more functions can be conducted simultaneously, and/or any function can be conducted in a series of steps.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the FIGURE, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

The invention claimed is:

1. A lighting assembly comprising:

at least first, second, third, fourth and fifth lighting devices; and at least first, second, third, fourth and fifth patterned diffusers, each of said patterned diffusers comprising a plurality of optical features and configured to cause at least 75% of light that enters the patterned diffuser to exit the patterned diffuser to produce a rectangular pattern of light, regardless of the pattern of the light which enters the patterned diffuser, the first patterned diffuser positioned to receive light from the first lighting device, the second patterned diffuser positioned to receive light from the second lighting device, the third patterned diffuser positioned to receive light from the third lighting device, the fourth patterned diffuser positioned to receive light from the fourth lighting device, the fifth patterned diffuser positioned to receive light from the fifth lighting device, wherein said first, second, third, fourth and fifth lighting devices and said first, second, third, fourth and fifth patterned diffusers arc configured and positioned such that when each of said first, second, third, fourth and fifth lighting devices is illuminated so that each of said first, second, third, fourth and fifth lighting devices emits light, a planar illumination surface can be positioned such that at least a portion of light emitted from each of said first, second, third, fourth and fifth lighting devices travels in a direction substantially perpendicular to said illumination surface, and:

at least 75 percent of light that passes through the first patterned diffuser projects into a first rectangular area on said surface defined by a first line segment, a second line segment, a third line segment and a fourth line segment;

at least 75 percent of light that passes through the second patterned diffuser projects into a second rectangular area on said surface defined by said first line segment, a fifth line segment, a sixth line segment and a seventh line segment;

at least 75 percent of light that passes through the third patterned diffuser projects into a third rectangular area on said surface defined by said second line segment, an eighth line segment, a ninth line segment and a tenth line segment;

at least 75 percent of light that passes through the fourth patterned diffuser projects into a fourth rectangular area on said surface defined by said third line segment, an eleventh line segment, a twelfth line segment and a thirteenth line segment;

at least 75 percent of light that passes through the fifth patterned diffuser projects into a fifth rectangular area on said surface defined by said fourth line segment, a fourteenth line segment, a fifteenth line segment and a sixteenth line segment.

2. A lighting assembly as recited in claim 1, wherein said first lighting device comprises at least one solid state light emitter.

3. A lighting assembly as recited in claim 1, wherein at least some light emitted by a light source in said first lighting device enters said first patterned diffuser through a first surface of said first patterned diffuser and exits said first patterned diffuser through a second surface of said first patterned diffuser.

4. A lighting assembly as recited in claim 3, wherein a plurality of optical features are on said first surface of said first patterned diffuser.

5. A lighting assembly comprising:

at least first, second, third, fourth and fifth lighting devices; and at least first, second, third, fourth and fifth patterned diffusers, each of said patterned diffusers comprising a plurality of optical features and configured to cause at least 75% of light that enters the patterned diffuser to exit the patterned diffuser to produce a square pattern of light, regardless of the pattern of the light which enters the patterned diffuser, the first patterned diffuser positioned to receive light from the first lighting device, the second patterned diffuser positioned to receive light from the second lighting device, the third patterned diffuser positioned to receive light from the third lighting device, the fourth patterned diffuser positioned to receive light from the fourth lighting device, the fifth patterned diffuser positioned to receive light from the fifth lighting device.

wherein said first, second, third, fourth and fifth lighting devices and said first, second, third, fourth and fifth patterned diffusers are configured and positioned such that when each of said first, second, third, fourth and fifth lighting devices is illuminated so that each of said first, second, third, fourth and fifth lighting devices emits light, a planar illumination surface can be positioned such that at least a portion of light emitted from each of said first, second, third, fourth and fifth lighting devices travels in a direction substantially perpendicular to said illumination surface, and:

at least 75 percent of light that passes through the first patterned diffuser projects into a first square area on said surface defined by a first line segment, a second line segment, a third line segment and a fourth line segment;

at least 75 percent of light that passes through the second patterned diffuser projects into a second square area on said surface defined by said first line segment, a fifth line segment, a sixth line segment and a seventh line segment;

at least 75 percent of light that passes through the third patterned diffuser projects into a third square area on said surface defined by said second line segment, an eighth line segment, a ninth line segment and a tenth line segment;

at least 75 percent of light that passes through the fourth patterned diffuser projects into a fourth square area on said surface defined by said third line segment, an eleventh line segment, a twelfth line segment and a thirteenth line segment;

at least 75 percent of light that passes through the fifth patterned diffuser projects into a fifth square area on said surface defined by said fourth line segment, a fourteenth line segment, a fifteenth line segment and a sixteenth line segment.

6. A lighting assembly as recited in claim 5, wherein said first lighting device comprises at least one solid state light emitter.

7. A lighting assembly as recited in claim 5, wherein at least some light emitted by a light source in said first lighting device enters said first patterned diffuser through a first surface of said first patterned diffuser and exits said first patterned diffuser through a second surface of said first patterned diffuser.

8. A lighting assembly as recited in claim 7, wherein a plurality of optical features are on said first surface of said first patterned diffuser.

9. A lighting assembly comprising:

at least first, second, third, fourth, fifth, sixth and seventh lighting devices; and at least first, second, third, fourth, fifth, sixth and seventh patterned diffusers, each of said patterned diffusers comprising a plurality of optical features and configured to cause at least 75% of light that enters the patterned diffuser to exit the patterned diffuser to produce a hexagonal pattern of light, regardless of the pattern of the light which enters the patterned diffuser, the first patterned diffuser positioned to receive light from the first lighting device, the second patterned diffuser positioned to receive light from the second lighting device, the third patterned diffuser positioned to receive light from the third lighting device, the fourth patterned diffuser positioned to receive light from the fourth lighting device, the fifth patterned diffuser positioned to receive light from the fifth lighting device, the sixth patterned diffuser positioned to receive light from the sixth lighting device, the seventh patterned diffuser positioned to receive light from the seventh lighting device, wherein said first, second, third, fourth, fifth, sixth and seventh lighting devices and said first, second, third, fourth, fifth, sixth and seventh patterned diffusers are configured such that when each of said first, second, third, fourth, fifth, sixth and seventh lighting devices is illuminated so that each of said first, second, third, fourth, fifth, sixth and seventh lighting devices emits light, a planar illumination surface can be positioned such that at least a portion of light emitted from each of said first, second, third, fourth, fifth, sixth and seventh lighting devices travels in a direction substantially perpendicular to said illumination surface, and:

at least 75 percent of light that passes through the first patterned diffuser projects into a first hexagonal area on said surface defined by a first line segment, a second line segment, a third line segment, a fourth line segment, a fifth line segment and a sixth line segment;

at least 75 percent of light that passes through the second patterned diffuser projects into a second hexagonal area on said surface defined by the first line segment, a seventh line segment, an eighth line segment, a ninth line segment, a tenth line segment and an eleventh line segment;

at least 75 percent of light that passes through the third patterned diffuser projects into a third hexagonal area on said surface defined by the second line segment, the eleventh line segment, a twelfth line segment, a thirteenth line segment, a fourteenth line segment and a fifteenth line segment;

at least 75 percent of light that passes through the fourth patterned diffuser projects into a fourth hexagonal area on said surface defined by the third line segment, the fifteenth line segment, a sixteenth line segment, a seventeenth line segment, an eighteenth line segment and a nineteenth line segment;

at least 75 percent of light that passes through the fifth patterned diffuser projects into a fifth hexagonal area on said surface defined by the fourth line segment, the nineteenth line segment, a twentieth line segment, a twenty-first line segment, a twenty-second line segment and a twenty-third line segment;

at least 75 percent of light that passes through the sixth patterned diffuser projects into a sixth hexagonal area on said surface defined by the fifth line segment, the twenty-third line segment, a twenty-fourth line segment, a twenty-fifth line segment, a twenty-sixth line segment and a twenty-seventh line segment;

at least 75 percent of light that passes through the seventh patterned diffuser projects into a seventh hexagonal area on said surface defined by the sixth line segment, the seventh line segment, the twenty-seventh line segment, a twenty-eighth line segment, a twenty-ninth line segment and a thirtieth line segment.

10. A lighting assembly as recited in claim 9, wherein said first lighting device comprises at least one solid state light emitter.

11. A lighting assembly as recited in claim 9, wherein at least some light emitted by a light source in said first lighting device enters said first patterned diffuser through a first surface of said first patterned diffuser and exits said first patterned diffuser through a second surface of said first patterned diffuser.

12. A lighting assembly as recited in claim 11, wherein a plurality of optical features are on said first surface of said first patterned diffuser.

13. A lighting assembly comprising:

at least first, second, third, fourth, fifth, sixth, seventh, eighth and ninth lighting devices at least first, second, third, fourth, fifth, sixth, seventh, eighth and ninth patterned diffusers, each of said patterned diffusers comprising a plurality of optical features and configured to cause at least 75% of light that enters the patterned diffuser to exit the patterned diffuser to produce an octagonal pattern of light or a square pattern of light, regardless of the pattern of the light which enters the patterned diffuser, the first patterned diffuser positioned to receive light from the first lighting device, the second patterned diffuser positioned to receive light from the second lighting device, the third patterned diffuser positioned to receive light from the third lighting device, the fourth patterned diffuser positioned to receive light from the fourth lighting device, the fifth patterned diffuser positioned to receive light from the fifth lighting device, the sixth patterned diffuser positioned to receive light from the sixth lighting device, the seventh patterned diffuser positioned to receive light from the seventh lighting device, the eighth patterned diffuser positioned to receive light from the eighth lighting device, the ninth patterned diffuser positioned to receive light from the ninth lighting device, wherein said first second, third, fourth, fifth, sixth, seventh, eighth and ninth lighting devices and said first, second, third, fourth, fifth, sixth, seventh, eighth and ninth patterned diffusers are configured and positioned such that when each of said first, second, third, fourth, fifth, sixth, seventh, eighth and ninth lighting devices is illuminated so that each of said first, second, third, fourth, fifth, sixth, seventh, eighth and ninth lighting devices emits light, planar illumination surface can be positioned such that at least a portion of light emitted from each of said first, second, third, fourth and fifth lighting devices travels in a direction substantially perpendicular to said illumination surface, and:

at least 75 percent of light that passes through the first patterned diffuser projects into a first octagonal area on said surface defined by a first line segment, a second line segment, a third line segment, a fourth line segment, a fifth line segment, a sixth line segment, a seventh line segment and an eighth line segment;

at least 75 percent of light that passes through the second patterned diffuser projects into a first square area on said surface defined by the first line segment, a ninth line segment, a tenth line segment and an eleventh line segment;

at least 75 percent of light that passes through the third patterned diffuser projects into a second octagonal area on said surface defined by the second line segment, the eleventh line segment, a twelfth line segment, a thirteenth line segment, a fourteenth line segment, a fifteenth line segment, a sixteenth line segment and a seventeenth line segment;

at least 75 percent of light that passes through the fourth patterned diffuser projects into a second square area on said surface defined by the third line segment, the seventeenth line segment, an eighteenth line segment and a nineteenth line segment;

at least 75 percent of light that passes through the fifth patterned diffuser projects into a third octagonal area on said surface defined by the fourth line segment, the nineteenth line segment, a twentieth line segment, a twenty-first line segment, a twenty-second line segment, a twenty-third line segment, a twenty-fourth line segment and a twenty-fifth line segment;

at least 75 percent of light that passes through the sixth patterned diffuser projects into a third square area on said surface defined by the fifth line segment, the twenty-fifth line segment, a twenty-sixth line segment and a twenty-seventh line segment;

at least 75 percent of light that passes through the seventh patterned diffuser projects into a fourth octagonal area on said surface defined by the sixth line segment, the twenty-seventh line segment, a twenty-eighth line segment, a twenty-ninth line segment, a thirtieth line segment, a thirty-first line segment, a thirty-second line segment and a thirty-third line segment;

at least 75 percent of light that passes through the eighth patterned diffuser projects into a fourth square area on said surface defined by the seventh line segment, the thirty-third line segment, a thirty-fourth line segment and a thirty-fifth line segment;

at least 75 percent of light that passes through the ninth patterned diffuser projects into a fifth octagonal area on said surface defined by the eighth line segment, the ninth line segment, the thirty-fifth line segment, a thirty-sixth line segment, a thirty-seventh line segment, a thirty-eighth line segment, a thirty-ninth line segment and a fortieth line segment.

14. A lighting assembly as recited in claim 13, wherein said first lighting device comprises at least one solid state light emitter.

15. A lighting assembly as recited in claim 13, wherein at least some light emitted by a light source in said first lighting device enters said first patterned diffuser through a first surface of said first patterned diffuser and exits said first patterned diffuser through a second surface of said first patterned diffuser.

16. A lighting assembly as recited in claim 15, wherein a plurality of optical features are on said first surface of said first patterned diffuser.

17. A method of lighting comprising:

illuminating first, second, third, fourth and fifth lighting devices so that each of said first, second, third, fourth and fifth lighting devices emits light in a lighting assembly, light from said first lighting device entering a first patterned diffuser, light from said second lighting device entering a second patterned diffuser, light from said third lighting device entering a third patterned diffuser, light from said fourth lighting device entering a fourth patterned diffuser, light from said fifth lighting device entering a fifth patterned diffuser, each of said patterned diffusers comprising a plurality of optical features configured to cause at least 75% of light that enters the patterned diffuser to exit the patterned diffuser to produce a rectangular pattern of light, regardless of the pattern of the light which enters the patterned diffuser, so that a planar illumination surface can be positioned such that at least a portion of light emitted from each of said first, second, third, fourth and fifth lighting devices travels in a direction substantially perpendicular to said illumination surface, and:

at least 75 percent of light that passes through the first patterned diffuser projects onto said illumination surface an illuminated first rectangular area on said surface defined by a first line segment, a second line segment, a third line segment and a fourth line segment;

at least 75 percent of light that passes through the second patterned diffuser projects onto said illumination surface an illuminated second rectangular area on said surface defined by said first line segment, a fifth line segment, a sixth line segment and a seventh line segment;

at least 75 percent of light that passes through the third patterned diffuser projects onto said illumination surface an illuminated third rectangular area on said surface defined by said second line segment, an eighth line segment, a ninth line segment and a tenth line segment;

at least 75 percent of light that passes through the fourth patterned diffuser projects onto said illumination surface an illuminated fourth rectangular area on said surface defined by said third line segment, an eleventh line segment, a twelfth line segment and a thirteenth line segment;

at least 75 percent of light that passes through the fifth patterned diffuser projects onto said illumination surface an illuminated fifth rectangular area on said surface defined by said fourth line segment, a fourteenth line segment, a fifteenth line segment and a sixteenth line segment.

18. A method as recited in claim 17, wherein said first lighting device comprises at least one solid state light emitter.

19. A method as recited in claim 17, wherein at least some light emitted by a light source in said first lighting device enters said first patterned diffuser through a first surface of said first patterned diffuser and exits said first patterned diffuser through a second surface of said first patterned diffuser.

20. A method as recited in claim 19, wherein a plurality of optical features are on said first surface of said first patterned diffuser.

21. A method of lighting comprising:

illuminating first, second, third, fourth and fifth lighting devices so that each of said first, second, third, fourth and fifth lighting devices emits light in a lighting assembly, light from said first lighting device entering a first patterned diffuser, light from said second lighting device entering a second patterned diffuser, light from said third lighting device entering a third patterned diffuser, light from said fourth lighting device entering a fourth patterned diffuser, light from said fifth lighting device entering a fifth patterned diffuser, each of said patterned diffusers comprising a plurality of optical features configured to cause at least 75% of light that enters the patterned diffuser to exit the patterned diffuser to produce a square pattern of light, regardless of the pattern of the light which enters the patterned diffuser, so that a planar illumination surface can be positioned such that at least a portion of light emitted from each of said first, second, third, fourth and fifth lighting devices travels in a direction substantially perpendicular to said illumination surface, and:

at least 75 percent of light that passes through the first patterned diffuser projects onto said illumination surface an illuminated first square area on said surface defined by a first line segment, a second line segment, a third line segment and a fourth line segment;

at least 75 percent of light that passes through the second patterned diffuser projects onto said illumination surface an illuminated second square area on said surface defined by said first line segment, a fifth line segment, a sixth line segment and a seventh line segment;

at least 75 percent of light that passes through the third patterned diffuser projects onto said illumination surface an illuminated third square area on said surface defined by said second line segment, an eighth line segment, a ninth line segment and a tenth line segment;

at least 75 percent of light that passes through said fourth patterned diffuser projects onto said illumination surface an illuminated fourth square area on said surface defined by said third line segment, an eleventh line segment, a twelfth line segment and a thirteenth line segment;

at least 75 percent of light that passes through said fifth patterned diffuser projects onto said illumination surface an illuminated fifth square area on said surface defined by said fourth line segment, a fourteenth line segment, a fifteenth line segment and a sixteenth line segment.

22. A method as recited in claim 21, wherein said first lighting device comprises at least one solid state light emitter.

23. A method as recited in claim 21, wherein at least some light emitted by a light source in said first lighting device enters said first patterned diffuser through a first surface of said first patterned diffuser and exits said first patterned diffuser through a second surface of said first patterned diffuser.

24. A method as recited in claim 23, wherein a plurality of optical features are on said first surface of said first patterned diffuser.

25. A method of lighting comprising:

illuminating first, second, third, fourth, fifth, sixth and seventh lighting devices so that each of said first, second, third, fourth, fifth, sixth and seventh lighting devices emits light in a lighting assembly, light from said first lighting device entering a first patterned diffuser, light from said second lighting device entering a second patterned diffuser, light from said third lighting device entering a third patterned diffuser, light from said fourth lighting device entering a fourth patterned diffuser, light from said fifth lighting device entering a fifth patterned diffuser, light from said sixth lighting device entering a sixth patterned diffuser, light from said seventh lighting device entering a seventh patterned diffuser, each of said patterned diffusers comprising a plurality of optical features configured to cause at least 75% of light that enters the patterned diffuser to exit the patterned diffuser to produce a hexagonal pattern of light, regardless of the pattern of the light which enters the patterned diffuser, so that a planar illumination surface can be positioned such that at least a portion of light emitted from each of said first, second, third, fourth, fifth, sixth and seventh lighting devices travels in a direction substantially perpendicular to said illumination surface, and:

at least 75 percent of light that passes through the first patterned diffuser projects onto an illumination surface an illuminated first hexagonal area on said surface defined by a first line segment, a second line segment, a third line segment, a fourth line segment, a fifth line segment and a sixth line segment;

at least 75 percent of light that passes through the second patterned diffuser projects onto said illumination surface an illuminated second hexagonal area on said surface defined by the first line segment, a seventh line segment, an eighth line segment, a ninth line segment, a tenth line segment and an eleventh line segment;

at least 75 percent of light that passes through the third patterned diffuser projects onto said illumination surface an illuminated third hexagonal area on said surface defined by the second line segment, the eleventh line segment, a twelfth line segment, a thirteenth line segment, a fourteenth line segment and a fifteenth line segment;

at least 75 percent of light that passes through the fourth patterned diffuser projects onto said illumination surface an illuminated fourth hexagonal area on said surface defined by the third line segment, the fifteenth line segment, a sixteenth line segment, a seventeenth line segment, an eighteenth line segment and a nineteenth line segment;

at least 75 percent of light that passes through the fifth patterned diffuser projects onto said illumination surface an illuminated fifth hexagonal area on said surface defined by the fourth line segment, the nineteenth line segment, a twentieth line segment, a twenty-first line segment, a twenty-second line segment and a twenty-third line segment;

at least 75 percent of light that passes through the sixth patterned diffuser projects onto said illumination surface an illuminated sixth hexagonal area on said surface defined by the fifth line segment, the twenty-third line segment, a twenty-fourth line segment, a twenty-fifth line segment, a twenty-sixth line segment and a twenty-seventh line segment;

at least 75 percent of light that passes through the seventh patterned diffuser projects onto said illumination surface an illuminated seventh hexagonal area on said surface defined by the sixth line segment, the seventh line segment, the twenty-seventh line segment, a twenty-eighth line segment, a twenty-ninth line segment and a thirtieth line segment.

26. A method as recited in claim 25, wherein said first lighting device comprises at least one solid state light emitter.

27. A method as recited in claim 25, wherein at least some light emitted by a light source in said first lighting device enters said first patterned diffuser through a first surface of said first patterned diffuser and exits said first patterned diffuser through a second surface of said first patterned diffuser.

28. A method as recited in claim 27, wherein a plurality of optical features are on said first surface of said first patterned diffuser.

29. A method of lighting comprising:

illuminating first, second, third, fourth, fifth, sixth, seventh, eighth and ninth lighting devices so that each of said first, second, third, fourth, fifth, sixth, seventh, eighth and ninth lighting devices emits light in a lighting assembly, light from said first lighting device entering a first patterned diffuser, light from said second lighting device entering a second patterned diffuser, light from said third lighting device entering a third patterned diffuser, light from said fourth lighting device entering a fourth patterned diffuser, light from said fifth lighting device entering a fifth patterned diffuser, light from said sixth lighting device entering a sixth patterned diffuser, light from said seventh lighting device entering a seventh patterned diffuser, light from said eighth lighting device entering an eighth patterned diffuser, light from said ninth lighting device entering a ninth patterned diffuser, each of said first, third, fifth, seventh and ninth patterned diffusers comprising a plurality of optical features configured to cause at least 75% of light that enters the patterned diffuser to exit the patterned diffuser to produce an octagonal pattern of light, regardless of the pattern of the light which enters the patterned diffuser, and each of said second, fourth, sixth and eighth patterned diffusers comprising a plurality of optical features configured to cause at least 75% of light that enters the patterned diffuser to exit the patterned diffuser to produce a square pattern of light, regardless of the pattern of the light which enters the patterned diffuser, so that a planar illumination surface can be positioned such that at least a portion of light emitted from each of said first, second, third, fourth, fifth, sixth, seventh, eighth and ninth lighting devices travels in a direction substantially perpendicular to said illumination surface, and:

at least 75 percent of light that passes through the first patterned diffuser projects onto said illumination surface an illuminated first octagonal area on said surface defined by a first line segment, a second line segment, a third line segment, a fourth line segment, a fifth line segment, a sixth line segment, a seventh line segment and an eighth line segment;

at least 75 percent of light that passes through the second patterned diffuser projects onto said illumination surface an illuminated first square area on said surface defined by said first line segment, a ninth line segment, a tenth line segment and an eleventh line segment;

at least 75 percent of light that passes through the third patterned diffuser projects onto said illumination surface an illuminated second octagonal area on said surface defined by the second line segment, the eleventh line segment, a twelfth line segment, a thirteenth line segment, a fourteenth line segment, a fifteenth line segment, a sixteenth line segment and a seventeenth line segment;

at least 75 percent of light that passes through the fourth patterned diffuser projects onto said illumination surface an illuminated second square area on said surface defined by the third line segment, the seventeenth line segment, an eighteenth line segment and a nineteenth line segment;

at least 75 percent of light that passes through the fifth patterned diffuser projects onto said illumination surface an illuminated third octagonal area on said surface defined by the fourth line segment, the nineteenth line segment, a twentieth line segment, a twenty-first line segment, a twenty-second line segment, a twenty-third line segment, a twenty-fourth line segment and a twenty-fifth line segment;

at least 75 percent of light that passes through the sixth patterned diffuser projects onto said illumination surface an illuminated third square area on said surface defined by the fifth line segment, the twenty-fifth line segment, a twenty-sixth line segment and a twenty-seventh line segment;

at least 75 percent of light that passes through the seventh patterned diffuser projects onto said illumination surface an illuminated fourth octagonal area on said surface defined by the sixth line segment, the twenty-seventh line segment, a twenty-eighth line segment, a twenty-ninth line segment, a thirtieth line segment, a thirty-first line segment, a thirty-second line segment and a thirty-third line segment;

at least 75 percent of light that passes through the eighth patterned diffuser projects onto said illumination surface an illuminated fourth square area on said surface defined by the seventh line segment, the thirty-third line segment, a thirty-fourth line segment and a thirty-fifth line segment;

at least 75 percent of light that passes through the ninth patterned diffuser projects onto said illumination surface an illuminated fifth octagonal area on said surface defined by the eighth line segment, the ninth line segment, the thirty-fifth line segment, a thirty-sixth line segment, a thirty-seventh line segment, a thirty-eighth line segment, a thirty-ninth line segment and a fortieth line segment.

30. A method as recited in claim 29, wherein said first lighting device comprises at least one solid state light emitter.

31. A method as recited in claim 29, wherein at least some light emitted by a light source in said first lighting device enters said first patterned diffuser through a first surface of said first patterned diffuser and exits said first patterned diffuser through a second surface of said first patterned diffuser.

32. A method as recited in claim 31, wherein a plurality of optical features are on said first surface of said first patterned diffuser.

* * * * *

UNITED STATES PATENT AND TRADEMARK OFFICE

CERTIFICATE OF CORRECTION

PATENT NO. : 9,310,026 B2
APPLICATION NO. : 11/949222
DATED : April 12, 2016
INVENTOR(S) : Gerald H. Negley It is certified that error appears in the above-identified patent and that said Letters Patent is hereby corrected as shown below:

Title Page, Other Publications, Page 3, Left Column

Please change: "Lagoubi et al., *Conditioning of N-Silicon by Photoelectrochimical Etching for Photovoltaic Application*, Proc. Of the 11th E.C. Photovoltaic Solar Energy Conference, Oct. 12, 1992-Oct. 16, 1992, pp. 250-253, XP008043956, pp. 252-253, Fig. 8." to -- Lagoubi et al., *Conditioning of N-Silicon by Photoelectrochemical Etching for Photovoltaic Application*, Proc. Of the 11th E.C. Photovoltaic Solar Energy Conference, Oct. 12, 1992-Oct. 16, 1992, pp. 250-253, XP008043956, pp. 252-253, Fig. 8. --

Title Page, Other Publications, Page 3, Left Column

Please change: "Lin et al. *Design and Fabrication of Omnidirectional Reflectors in the Visible Range*, Journal of Modern Otpics, vol. 52, No. 8, May2005, pp. 1155-1160." to -- Lin et al. *Design and Fabrication of Omnidirectional Reflectors in the Visible Range*, Journal of Modern Optics, vol. 52, No. 8, May 2005, pp. 1155-1160. --

Title Page, Other Publications, Page 3, Left Column

Please change: "Perrin et al., *Left-Handed Electromagnetism obtained via Nanostructured Metamaterials: Comparison with that from Microstructured Photonic Cyrstals*,Journal of Opics A: Pure and Applied Optics 7 (2005), S3-S11." to -- Perrin et al., *Left-Handed Electromagnetism obtained via Nanostructured Metamaterials: Comparison with that from Microstructured Photonic Crystals*, Journal of Optics A: Pure and Applied Optics 7 (2005), S3-S11. --

Signed and Sealed this
Twenty-eighth Day of June, 2016

Michelle K. Lee

Michelle K. Lee
*Director of the United States Patent and Trademark Office*

Title Page, Other Publications, Page 3, Left Column

Please change: "Schnitzer, et al., *30% External Quantum Efficieny from Surface Textured, Thin-Film Light-Emitting Diodes*, Applied Physics Left. 63(16), Oct. 18, 1993, pp. 2174-2176." to -- Schnitzer, et al., *30% External Quantum Efficiency from Surface Textured, Thin-Film Light-Emitting Diodes*, Applied Physics Lett. 63(16), Oct. 18, 1993, pp. 2174-2176. --

Title Page, Other Publications, Page 3, Right Column

Please change: "Streusel et al., *High Brightness AlGaInP Light-Emitting Diodes*, IEEE Journal on Selected Topis in Quantum Electronics, Vo. 8, Now. 2, Mar./Apr. 2002, pp. 321-332." to -- Streubel et al., *High Brightness AlGaInP Light-Emitting Diodes*, IEEE Journal on Selected Topics in Quantum Electronics, Vol. 8, No. 2, Mar./Apr. 2002, pp. 321-332. --

Title Page, Other Publications, Page 3, Right Column

Please change: "Kim, J. K. Et al., "Strongly Enhanced Phosphor Efficiency in GaInN White Light-Emitting Diodes Using Remote Phosphor Configuration and Diffuse Reflector Cup," Japanese Journal of Applied Japan Socient of applied Physics, Tokyo, JP, vol. 44, No. 20-23, XP-001236966, Jan. 1, 2005." to -- Kim, J. K. Et al., "Strongly Enhanced Phosphor Efficiency in GaInN White Light-Emitting Diodes Using Remote Phosphor Configuration and Diffuse Reflector Cup," Japanese Journal of Applied Physics, Japan Society of Applied Physics, Tokyo, JP, vol. 44, No. 20-23, XP-001236966, Jan. 1, 2005. --

Title Page, Other Publications, Page 3, Right Column

Please change: "Sakai et al., *Experimental Investigation of Dependence of Electrical Characteristics on Device Pammeters in Trench Mos BarrierShottky Diodes*, Proceedings of 1998 International Symposium on power Semiconductor Devices & Ics, Kyoto, pp. 293-296, Jun. 1998." to -- Sakai et al., *Experimental Investigation of Dependence of Electrical Characteristics on Device Parameters in Trench MOS Barrier Schottky Diodes*, Proceedings of 1998 International Symposium on Power Semiconductor Devices & ICs, Kyoto, pp. 293-296, Jun. 1998. --

In the Specification

Col. 17, Lines 50-51

Please change: "third patterned diffuser 608, exits the first patterned diffuser 608 and contacts the illumination surface 611 in a" to -- third patterned diffuser 608, exits the third patterned diffuser 608 and contacts the illumination surface 611 in a In the Claims Col. 18, Line 62, Claim 1

Please change: "patterned diffusers arc configured and positioned such" to -- patterned diffusers are configured and positioned such --

Col. 22, Lines 34-35, Claim 13

Please change: "seventh, eighth and ninth lighting devices emits light, planar illumination surface can be positioned such that" to -- seventh, eighth and ninth lighting devices emits light, a planar illumination surface can be positioned such that --